US007530313B2

(12) United States Patent
Chamlee et al.

(10) Patent No.: US 7,530,313 B2
(45) Date of Patent: May 12, 2009

(54) SELF-DESTRUCT FUZE DELAY MECHANISM

(75) Inventors: William D. Chamlee, Texarkana, TX (US); Jerry E. Smith, Queen City, TX (US); Berry W. Flournoy, Wake Village, TX (US)

(73) Assignee: Day & Zimmerman, Inc., Texarkana, TX (US)

( * ) Notice: Subject to any disclaimer, the term of this patent is extended or adjusted under 35 U.S.C. 154(b) by 301 days.

(21) Appl. No.: 11/616,625

(22) Filed: Dec. 27, 2006

(65) Prior Publication Data

US 2007/0261585 A1 Nov. 15, 2007

Related U.S. Application Data

(63) Continuation-in-part of application No. 11/383,116, filed on May 12, 2006, now abandoned.

(51) Int. Cl.
*F42C 15/34* (2006.01)
*F42C 15/38* (2006.01)

(52) U.S. Cl. ..... 102/254

(58) Field of Classification Search ..... 102/254, 102/255, 256, 257, 188, 304.4, 313.3, 314.2, 102/321.5, 457, 911; 89/36.01, 36.02, 36.03, 89/36.04, 36.07, 36.08, 36.09, 36.12, 36.17
See application file for complete search history.

(56) References Cited

U.S. PATENT DOCUMENTS 2,454,281 A * 11/1948 Hicks ..... 102/489
2,641,185 A * 6/1953 Lockett ..... 102/321
2,669,929 A * 2/1954 Shull et al. ..... 102/204
2,741,182 A * 4/1956 Faust et al. ..... 102/257
2,779,276 A * 1/1957 Clary, Jr. ..... 102/392
3,779,168 A * 12/1973 Hinely et al. ..... 102/255
3,792,663 A * 2/1974 Schneider, Jr. ..... 102/257
4,653,401 A 3/1987 Gatti
4,998,476 A 3/1991 Rudenauer et al.
5,373,790 A 12/1994 Chemiere et al.
5,932,834 A 8/1999 Lyon et al.

* cited by examiner

*Primary Examiner*—Bret Hayes
(74) *Attorney, Agent, or Firm*—Caesar, Rivise, Bernstein, Cohen & Pokotilow, Ltd.

(57) ABSTRACT

An exemplary self-destruct fuze delay for a submunition includes a container filled with an activation fluid, a spring-loaded ampoule breaker to break the container upon deployment of the munition, a spring-loaded self-destruct firing pin to initiate a secondary detonator in close proximity to a primary detonator, and an interlock ball supported by the ampoule breaker that locks the self-destruct firing pin away from the secondary detonator. The ampoule breaker includes a piston and a timing ball, which accesses the activation liquid. The action of the activation liquid on the timing ball over time causes the timing ball to erode until it is forced into the container by the spring-loaded piston. The movement of the piston frees the interlock ball, allowing the spring-loaded self-destruct firing pin to move under force and impact or initiate the secondary detonator. Initiation of the secondary detonator destroys the primary detonator and, depending upon slide location, either sterilizes the submunition, or destroys the entire submunition.

15 Claims, 19 Drawing Sheets

SELF-DESTRUCT FUZE DELAY MECHANISM

CROSS-REFERENCE TO RELATED APPLICATIONS

This utility application is a Continuation-in-Part application of, and claims the benefit under 35 U.S.C. §120 of application Ser. No. 11/383,116 filed on May 12, 2006 entitled SELF-DESTRUCT FUZE DELAY MECHANISM and whose entire disclosure is incorporated by reference herein.

BACKGROUND OF THE INVENTION

1. Field of Invention

The present invention relates to fuzes for submunissions of the type which are disbursable by a vehicle such as a projectile or carrier shell, and in particular, to a self-destructing fuze that automatically self-destructs or self-neutralizes the submunition if the primary mode of detonation fails.

2. Description of Related Art

For many years, submunitions included in the family of Improved Conventional Munitions (ICM) employed a simple, low cost point detonating fuze for initiating a main charge upon impact. Reliability of the fuze was in the 95% range, meaning fairly large quantities of submunitions would not function for various reasons. This failure rate of about 5% presents both an environmental and a humanitarian hazard. Hazardous duds (e.g., armed but unexploded submunitions) remained on the battle field indefinitely and with potentially undesirable consequences to friendly troops and/or civilians.

The currently used M223 fuze incorporated unique and effective safety features for personnel and property protection during the manufacturing and loading process. Key among these safety features is a stabilizer ribbon attached to an arming screw that, in its engaged position, locks a detonator-containing slide in an unaligned position, thereby preventing any possible contact of a primary firing pin with the detonator. Upon deployment of the submunition from its carrier (e.g., howitzer projectile) the stabilizer ribbon becomes exposed to the air stream wind resistance and unfurls. The combination of wind resistance, induced spin of the submunition, and/or vibration causes the submunition to rotate relative to the ribbon, causing an arming screw to back out, which in turn releases a spring loaded slide that shifts, allowing the firing pin to align with the detonator. Upon impact, the firing pin, which is typically attached to a small weight, drives into the detonator causing initiation of the main charge.

In the case of projectile carrier, the entire submunition is spinning at a very high rate at ejection and the ribbon's resistance to spinning causes the arming screw to back out. However, a missile is a non-spin carrier so rotation is not available to arm the unit. Instead, the arming screw backs out because of the vibration induced as the submunition descends. That is, a loose fit between the arming screw and weight allows the arming screw to back out, which releases the spring loaded slide to align the firing pin with the detonator.

The failure of the armed submunitions described above results in hazardous duds. Incidence of death and injury to innocent victims from such hazardous duds, coupled with an international moratorium on antipersonnel mines, demonstrates a need to find a solution that would minimize these residuals on the battle field. It would be beneficial to provide a Self-Destruct Fuze (SDF) that, in the event of failure of the fuze in the primary mode, would cause a secondary action to either explode the entire submunition or at least destroy the detonator (e.g., sterilize the submunition, otherwise referred to as sterilization).

U.S. Pat. No. 5,373,790, to Chemiere, et al., discloses a mechanical system for self-destruction of a submunition, having a warhead initiated by a pyrotechnic sequence, a main striker and a priming device composed of a slide movable between a safety position and an armed position, and which has a device for priming the charge. The self-destruction system includes a secondary striker mounted inside a receptacle of the slide, and a control device that releases the secondary striker after a delay. The secondary striker is integral with a holding element held abutting a seat by the urging of an arming spring. The control device of the secondary striker has a corrosive agent stored in a glass ampoule that, when broken by the holding element, chemically attacks the holding element to release it from its seat. When the holding element is released, the arming spring moves the secondary striker to contact the detonator and destroy the munition.

U.S. Pat. No. 4,653,401, to Gatti, discloses a self-destructing fuze having a first striker member movable within the body of the fuze and able to come into contact with a detonator to cause it to explode, and a slide that is movable in a direction substantially orthogonal to the direction in which the first striker member is movable. A second striker member is disposed in the slide, and is movable from a first position in which it elastically deforms a spring and is held at a predetermined distance from the detonator, to a second position in which it comes into contact with the detonator to cause it to explode. The movement of the second striker member is delayed by a section of wire that under a force exerted by the spring is plastically deformed over time. The plastic deformation eventually frees the second striker member allowing its movement to the second position and against the detonator to cause it to explode.

U.S. Pat. No. 5,932,834, to Lyon, et al., discloses an auto-destruct fuze that provides a primary mode detonator and a delayed auto-destruct/self-neutralize mode detonator for a grenade. The mechanics for the primary mode detonator is similar to the M223 fuze. Operation of the auto-destruct/self-neutralize is based on a Liquid Annular Orifice Device (LAOD) that is released from a locked position upon expulsion of the LAOD from a storage container. The LAOD moves slowly under the urging of a spring and eventually releases a clean-up firing pin which activates a clean-up detonator to activate the primary mode detonator and destructs or self-neutralizes the grenade.

U.S. Pat. No. 4,998,476, to Rüdenauer, et al., discloses a fuze for a bomblet including a slide having a detonator triggered in response to an impact and which undergoes a transition during the free flight of the bomblet from a safe position into an armed position. The slide also includes a hydraulic or pneumatic cylinder-piston retarding device and a spring biased self-destruct pin which is operatively coupled to the device and has a self-destruct detonator associated therewith. The retarding device is freed upon movement of the slide to the armed position, and releases the movement of the self-destruct pin after a time delay to trigger the self-destruct detonator and, if needed, the primary detonator.

Numerous variations of self-destruct (SD) devices, working in conjunction with proven safety features of the stabilizer ribbon arming screw, and sliding arrangement have been developed with various degrees of success. In one variant, the SD feature centers around a microelectronic battery and circuit with a complicated attendant initiating device. Two other variants employ a critical pyrotechnic delay column to achieve the necessary time lapse. Even if successful, the critical manufacturing process and high costs of these candidates raise long term and expensive productabilty concerns.

Even with the current self-destruct fuze development, it would still be beneficial to provide reliable low-cost and improved self-destruct delay devices or mechanisms for automatically destroying or self-neutralizing submunitions after a time delay to minimize undesirable consequences to friendly troops and/or civilians. All references cited herein are incorporated herein by reference in their entireties.

BRIEF SUMMARY OF THE INVENTION

In accordance with the preferred embodiments of the invention, a self-destruct fuze delay device for a submunition is provided, with the submunition having a longitudinal access, a main charge, and a detonating fuze with a movable slide for initiating the main charge upon impact. The self-destruct fuze delay device includes a detonator mounted to the fuze slide, a delay mechanism arranged within the submunition offset and substantially orthogonal to the submunition's longitudinal axis, and an activation mechanism. The delay mechanism includes an energizing source (e.g., compression spring, gas chamber), a restraining link (e.g., plunger, rod), and a self-destruct firing pin attached to the restraining link at a first portion thereof proximate to the detonator. The restraining link also has a second portion longitudinally extending from the first portion away from the detonator and attached to the fuze slide. The first portion is movable from a first position, in which it is held by it attachment to the second portion at a predetermined distance from the detonator, to a second position in which the first portion is separated from the second portion and the self-destruct firing pin is urged toward the detonator by the energizing source. The activation mechanism separates the first portion from the second portion after a predetermined delay, with the second portion remaining attached to the fuze slide after separation from the first portion.

While not being limited to a particular theory, the activation mechanism may include a container (e.g., glass ampoule) holding a fluid (e.g., acid, solution, reactant, liquid) for corroding the restraining link between the first portion and the second portion to separate the first portion form the second portion, and a breaking member (e.g., ampoule weight that impacts the container to release the fluid toward the restraining link). Moreover, this embodiment may also include a wick adjacent the restraining link at a predetermined area between the first portion and the second portion that collects the fluid from the container and isolates the collected fluid onto the predetermined area to facilitate the corroding of the restraining link. In accordance with the preferred embodiments, the detonating fuze may also have a main detonator in the fuze slide moveable between a safety position and an armed position, wherein the urging of the self-destruct firing pin toward the detonator by the energizing source causes the detonator to explode, which causes the main detonator to explode.

In another preferred embodiment of the invention, a self-destruct fuze delay device is provided, preferably for a submunition having a longitudinal axis, a main charge and a detonating fuze having a movable slide for initiating a main charge upon impact. The self-destruct fuze delay includes a detonator mounted to the fuze slide, a delay mechanism arranged within the submunition substantially orthogonal to the submunition's longitudinal axis, and an activating mechanism. The delay mechanism includes an energizing source (e.g., compression spring, pressurized gas container), a restraining link (e.g, piston, rod) having a first end attached to the self-destruct firing pin and a second end attached to the fuze slide. The restraining link is moveable from a first position, in which it is held by its attachment to the fuze slide at a predetermined distance from the detonator, to a second position in which the restraining link is separated from its attachment to the fuze slide and the self-destruct firing pin is urged toward the detonator by the energizing source. The activation mechanism separates the restraining link from its attachment to the detonating fuze slide. The activation mechanism includes a container (e.g., glass ampoule) holding a fluid (e.g., acid, solution, liquid) for corroding the restraining link, and a wick adjacent a predetermined area of the restraining link, with the wick being porous to absorb and draw the fluid from the container onto the restraining link at the predetermined area to facilitate the corroding and separation of the restraining link from attachment to the fuze slide.

While not being limited to a particular theory, the restraining link of this preferred embodiment may include a first portion proximate to the detonator, a second portion distal to the detonator and attached to the fuze slide, with the first portion and the second portion defined by the predetermined area. In this arrangement, the restraining link is separated from its attachment to the fuze slide at the predetermined area with the second portion remaining attached to the fuze slide after the separation. In the preferred embodiments, the predetermined area between the first portion and the second portion is preferably structurally weaker (e.g., undercut, thinner) than the first portion and the second portion to pulling forces along the longitudinal axis of the restraining link.

Another preferred embodiment of the invention includes a method or means for self-destructing a detonator of the submunition having a detonating fuze with a moveable slide upon deployment into the air. The method includes releasing an activation liquid from a container, absorbing the activation liquid with a porous wick, directing the absorbed activation liquid onto a predetermined area of a restraining link having a firing pin and held in place via attachment to the fuze slide, corroding the predetermined area with the directed activation liquid, separating the restraining link at the predetermined area, urging the firing pin toward the detonator, and colliding the firing pin into the detonator to destroy the detonator. The method may also include separating the restraining link at the predetermined area into a first portion having the firing pin and the second portion remaining attached to the fuze slide.

In yet another preferred embodiment of the invention, a self-destruct fuze delay device is provided, preferably for a submunition having a longitudinal axis, a main charge and a detonating fuze having a movable slide for initiating a main charge upon impact. The self-destruct fuze delay includes a detonator mounted to the fuze slide, a delay mechanism offset and substantially orthogonal to the longitudinal axis, a restraining unit movable within the movable slide, and an activation mechanism offset from the delay mechanism and supporting the restraining unit. The delay mechanism includes an energizing source and a self-destruct firing pin, with the self-destruct firing pin aligned with the detonator and urged toward the detonator in a first direction by the energizing source. The restraining unit is movable between a first position within the movable slide, in which the restraining unit abuts the self-destruct firing pin and holds the self-destruct firing pin away from the detonator, and a second position within the movable slide offset from the first position in a second direction in which the restraining unit allows the energizing source to move the self-destruct firing pin into the detonator. The activation mechanism supports the restraining unit in the first position against the self-destruct firing pin, and is adapted to shift after a delay and release its support of the restraining unit against the self-destruct firing pin to allow movement of the restraining unit to the position.

In still another preferred embodiment of the invention, a self-destruct fuze delay device is provided, preferably for a submunition having a longitudinal axis, a main charge and a detonating fuze having a movable slide for initiating a main charge upon impact. The self-destruct fuze delay includes a detonator mounted to the fuze slide, a delay mechanism offset and substantially orthogonal to the longitudinal axis, an activation mechanism offset from the delay mechanism, and a restraining unit movable within the movable slide. The delay mechanism includes an energizing source and a self-destruct firing pin, with the self-destruct firing pin aligned with the detonator and urged toward the detonator in a first direction by the energizing source. The activation mechanism includes a container holding a fluid, and a breaking member that breaks the container and accesses the fluid, which erodes the breaking member over a delay and releases a hold against the self-defense firing pin. The restraining unit is movable between a first position supported by the activation mechanism against the self-destruct firing pin to hold the self-destruct firing pin away from the detonator, and a second position that releases the hold against the self-destruct firing pin and allows the energizing source to move the self-destruct firing pin into the detonator.

Yet still another preferred embodiment of the invention includes a method or means for self-destructing a detonator of the submunition having a detonating fuze with a moveable slide upon deployment into the air. The method includes breaking a container held within the movable slide, moving a breaking member to a first position partially in the container, accessing an activation liquid in a container, eroding the breaking member with the activation liquid, moving the breaking member to a second position further into the container, shifting a restraining unit within the movable slide, releasing a firing pin toward the detonator, and colliding the firing pin into the detonator to initiate the detonator and destroy the submunition.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE PREFERRED EMBODIMENTS

Figure 1:
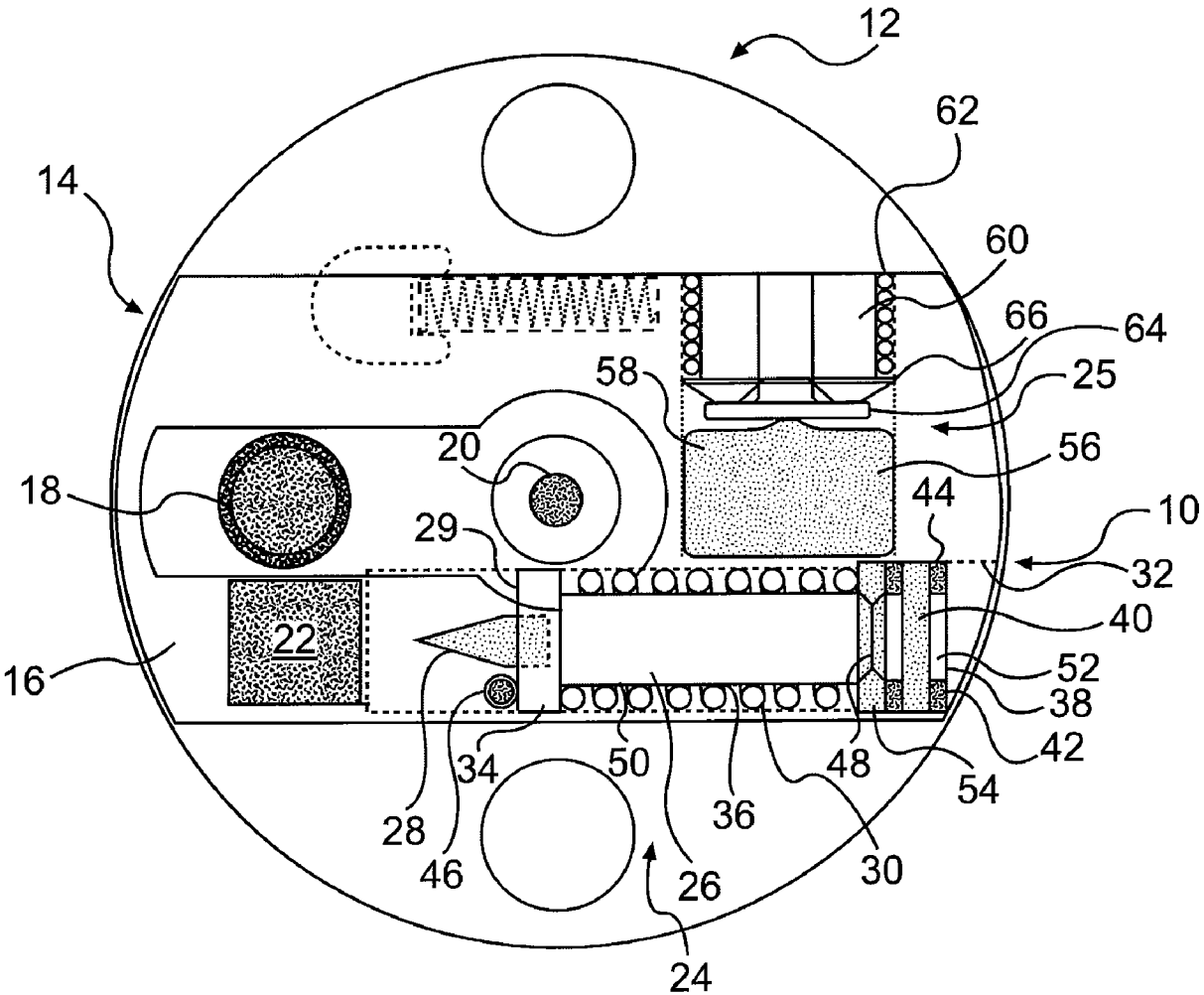
FIG. 1 is a top sectional view of the self-destruct fuze delay device in accordance with the preferred embodiments.

Exemplary embodiments for a self-destruct fuze delay device are described with reference to FIGS. 1-13. While not being limited to a particular theory, in general, an exemplary self-destruct fuze delay for a submunition includes an ampoule filled with an activation fluid (e.g., reactant, acid, solution, liquid), a spring-loaded pin to break the ampoule upon deployment of the munition, and a wick to collect and retain the activation fluid in contact with a spring loaded restraining link having an embedded firing pin. The activation fluid contacts the restraining link, preferably via the wick, at a predetermined area that is preferably weakened (e.g., undercut). The action of the activation fluid on the restraining link causes the link to fail at the predetermined area, allowing a severed portion with the embedded firing pin to move under force (e.g., spring, gas) and impact or initiate a detonator (e.g., M55). The detonator is in close proximity to a primary detonator (e.g., M55) typically used to initiate a main charge of the submunition. Initiation of the detonator, which is a secondary detonator, destroys the primary detonator and either sterilizes the submunition, or depending upon slide location, destroys the entire submunition.

The time required for the activation fluid to react with the restraining link and achieve failure at the predetermined location of the restraining link is the predetermined time necessary to satisfy desired delay requirements for the self-destruct fuze. The primary fuze also retains the positive operation of the M223 fuze, that is, it utilizes the stabilizer ribbon, firing pin and slide to retain the known out-of-line safety features.

Although the preferred self-destruct fuze delay device is applicable to all the various ICM items, in the interest of brevity, the exemplary self-destruct fuze devices are generally tailored toward use in the Guided Multiple Launch Rocket System (GMLRS). The GMLRS warhead typically contains 404 submunitions, each with its own self-destruct (SD) fuze. While not being limited to a particular theory, the submunitions typically are disbursed via a center core burster that explodes in flight creating ample pressure to burst the warhead casing, and allowing the currently-used submunition's random dispersion into the atmosphere.

In general, as each submunition is disbursed into the atmosphere, the impact of the air stream causes the submunition's stabilizer ribbon to unfurl, allowing an arming screw to back out and a slide to move to its armed position. Upon impact, the firing pin is free to pierce the primary detonator and cause a subsequent main charge explosion, which destroys the submunition. Damaged fuzes and fuzes that arm properly but come into contact with the ground or a target via side impact may fail to initiate the main charge resulting in residual hazardous duds. A hazardous dud is a submunition that still has its fuze attached and its primary detonator present that together could potentially initiate the main charge. A hazardous dud is different than an unexploded ordinance, which is a submunition that has no means of initiation (e.g., primary detonator is missing or destroyed).

The delay necessary for the activation liquid to corrode the restraining link to failure (e.g., about 25 seconds minimum to 30 minutes) is greater than the foreseeable flight time of the submunition, which ends when the submunition reaches the ground or target. This delay allows the primary detonator to initiate the main submunition charge when the submunition strikes the ground or target. The self-destruct fuze delay device is designed to destroy the submunition if the submunition fails to explode after it strikes the ground or target.

Other advantages, characteristics and details of the invention will emerge from the explanatory description thereof provided below with reference to the attached drawings and examples, but it should be understood that the present invention is not deemed to be limited thereto. Toward that end, FIG. 1 depicts an exemplary self-destruct fuze delay device 10 as a detonating fuze 14 encased within a submunition 12. The submunition 12 includes a fuze slide 16 housing a primary detonator 18 that is movable with the slide between a safety position (shown), where the primary detonator is not aligned with a main striker 20, and an armed position, where the primary detonator is located opposite the main striker and aligned along the longitudinal axis of the submunition between the main striker and the submunition. The slide 16 also houses the self-destruct (SD) fuze delay device 10.

Still referring to FIG. 1, the SD fuze delay device 10 includes a secondary detonator 22 aligned with a delay mechanism 24 that is arranged in the slide 16 offset and substantially orthogonal to the longitudinal axis of the submunition 12. The SD fuze delay device 10 also includes an activation mechanism 25 adjacent the delay mechanism 24 for activating the delay mechanism and causing the secondary detonator 22 to explode. The explosion of the secondary detonator 22 activates the primary detonator 18, causing it to explode and set off the main charge 20 if the primary detonator is aligned therewith. Preferably, the secondary detonator 22 remains adjacent the primary detonator 18 regardless of the position of the primary detonator to ensure that output from an explosion of the second detonator initiates the primary detonator. This ensures one of the three potential outcomes upon dispersion of the submunition 12 into the atmosphere, as set forth below.

If the detonating fuze 14, which includes the primary detonator 18, the slide 16, and the primary striker 20, functions normally, the submunition 12 explodes and the SD fuze delay device 10 is destroyed in the process. If the detonating fuze 14 functions normally to the point that the slide 16 moves into its armed position, but the submunition 12 fails to explode, the SD fuze delay device 10 will initiate the primary detonator 18 and, in turn, will then fire the main charge to explode the submunition. If the detonating fuze 14 does not function normally so that the slide 16 remains in the safety position or does not reach the armed position, then the SD fuze delay device 10 will initiate the primary detonator 18 but likely not the main charge, resulting in a sterilized submunition or unexploded ordinance.

Figure 2:
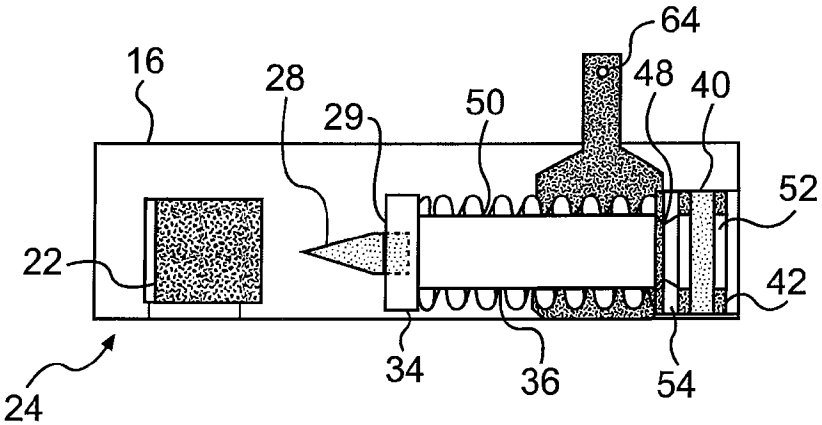
FIG. 2 is a side sectional view of the self-destruct fuze delay device shown in FIG. 1.

Referring in particular to FIGS. 1 and 2, the delay mechanism 24 includes a restraining link 26, a secondary firing pin 28 and a compression spring 30. The secondary or self-destruct firing pin 28 is attached to a front end 29 of the restraining link 26, which is transitionally movable in a receptacle or channel 32 of the slide 16. As can best be see in FIGS. 1, 2 and 6, the secondary firing pin 28 is partially embedded in a piston 34 of the restraining link 26. The piston 34 is extended opposite the secondary firing pin 28 by an axial rod 36 which freely passes inside the compression spring 30 and is attached at its distal end 38 to the slide 16 via a retainer pin 40. Preferably, the retainer pin 40 slides through a transverse opening of the axial rod 36 and within a spring retainer 40 that holds the compression spring 30, retainer pin 40 and axial rod 36 together and seated against an inner wall 44 of the slide 16. The compression spring 30 is mounted in a tensioned state around the axial rod 36 and is positioned between the piston 34 and spring retainer 42 to urge the piston, and thus the restraining link 26 and the secondary firing pin 28 toward the secondary detonator 22. Before deployment, a lockout pin 46 is attached to the slide 16 and abuts the first end 29 of the restraining link 26 to prevent movement of the restraining link towards the secondary detonator 22.

While not being limited to a particular theory, the axial rod 36 includes a weakened area 48 that defines a first portion 50 and a second portion 52 of the restraining link 26. The first portion 50 is proximate or adjacent to the secondary detonator 22 and includes the secondary firing pin 28, the piston 34 and part of the axial rod 36 extending from the piston. The second portion 52 is distal or away from the secondary firing pin 28 and is fixedly attached to the slide 16 via the retainer pin 40. The weakened area 48 is a predetermined part of the axial rod 36 that is constructed weaker than the remainder of the axial rod to fail upon application of a reactant (e.g., corrosive agent, acid, solution) and release the first portion 50 toward the secondary detonator 22. For example, the weakened area may include a circumferential plane or ring section that is undercut (e.g., having walls thinner than the walls of the adjacent first and second portions). Furthermore, a wick 54 is positioned adjacent, and preferably encircles the weakened area 48. The wick 54 is made of a porous material that absorbs the reactant fluid and directs it to the weakened area 48 to facilitate the corrosion of the restraining link 26 at the weakened area, as is described, for example, in greater detail below.

Figure 3:
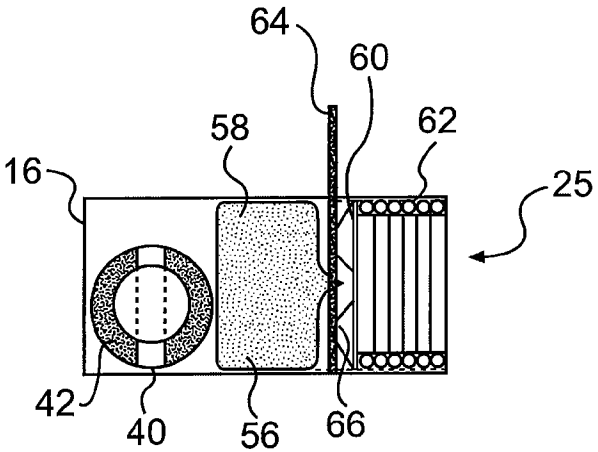
FIG. 3 is another side sectional view orthogonal to the view of FIG. 2 of the self-destruct fuze delay device.

As can best be seen in FIGS. 1 and 3, the SD fuze delay device 10 also includes an activation mechanism 25 that communicates with and, after a delay, releases the first portion 50 of the restraining link 26 from the second portion 52, which allows the compression spring 30 to urge the secondary firing pin into the secondary detonator 22. While not being limited to a particular theory, the activation mechanism is offset from the channel 32 that houses the delay mechanism 24. The activation mechanism 25 includes a container 56 (e.g., glass ampoule) holding a reactant fluid 58. The reactant fluid 58 is a corrosive agent (e.g., acid or solution of liquid or gas) that when placed in contact with the retraining link, causes the axial rod 36 to corrode, fail and break, preferably at the weakened area 48, thereby allowing the compression spring 30 to separate and move the piston 34 and the secondary firing pin 28 toward the secondary detonator 22 and activate the detonator upon impact.

The activation mechanism 25 also includes an ampoule weight 60, a compression spring 62 and a spring retainer clip or pin 64. In the exemplary embodiment of FIGS. 1 and 3, and the exploded view of FIG. 5, the compression spring 62 is mounted in a tension state around the ampoule weight 60 between a shoulder 66 of the ampoule weight and an inner wall 68 of the slide 16. The spring retaining pin 64 keeps the compressed spring 62 in its tensioned state, and thereby keeps the container 56 safe from impact by the ampoule weight 60. The ampoule weight 60 is a breaking member that, but for the spring retainer pin 64, is urged by the compression spring 62 into impact with the container 56, causing the container to break and release the reactant fluid 58. Therefore, when placed as shown in FIGS. 1 and 3, the spring retainer pin 64 prevents activation of the SD fuze delay device 10. In addition to breaking the container 56, ampoule weight 60 also preferably acts as a plunger and pushes the released fluid 58 toward the delay mechanism 24 whereupon the fluid is absorbed by the wick 54 and corrodes the weakened area 48 to release the first portion 50 toward the secondary detonator 22.

Figure 4:
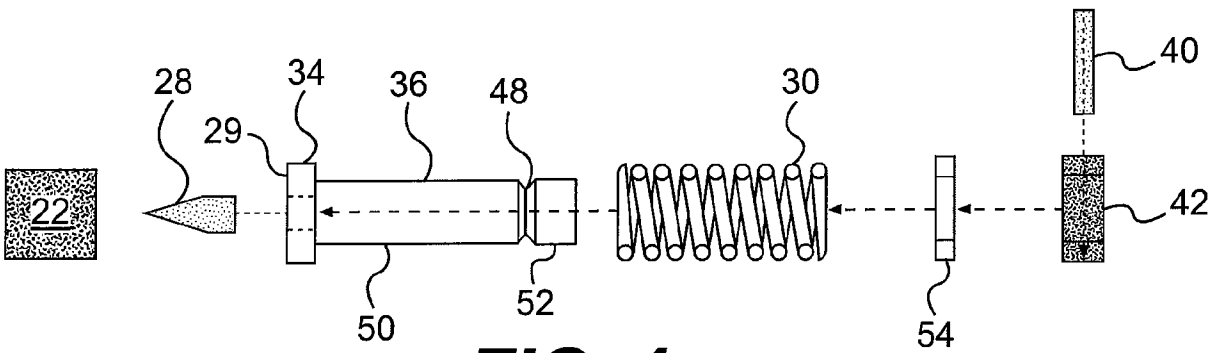
FIG. 4 is an exploded view of a delay mechanism for the preferred self-destruct fuze delay device.
Figure 5:
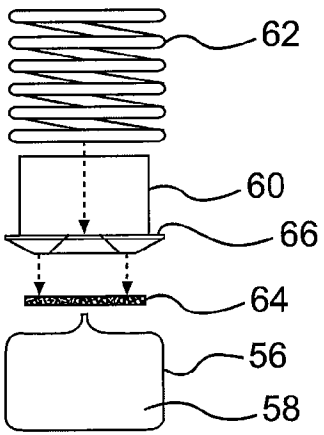
FIG. 5 is an exploded view of an activation liquid assembly for the preferred self-destruct fuze delay device.

FIG. 4 is an exploded view of the delay mechanism 24, the secondary detonator 22 and the wick 54. FIG. 5 shows an exploded view of the activation mechanism 25. FIGS. 4 and 5 are provided to help show the structure and association of the elements of the SD fuze delay device 10. FIGS. 6A-D illustrate a sequence of the delay mechanism 24 with the secondary detonator 22 and the wick 54 from a time prior to deployment of the submunition 12 to initiation of the secondary detonator, as will be described in greater detail below.

Figure 6A:
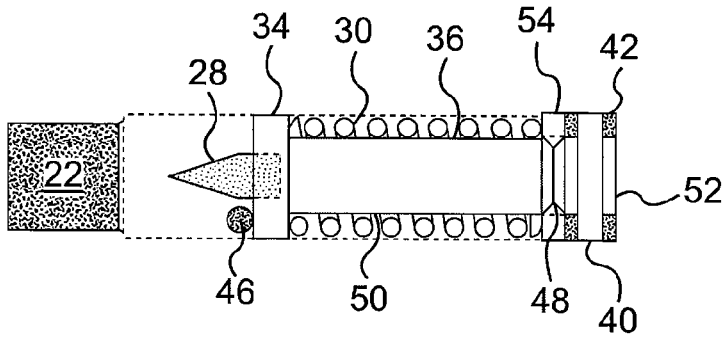
FIG. 6A is a side sectional view of the delay mechanism at a first state.

Upon deployment of the submunition 12, the self-destruct fuze delay device 10 self-destructs the submunition after a preset delay if the submunition fails to explode upon its impact with the ground or a target. FIG. 6A depicts the delay mechanism 24 before deployment into the atmosphere. When an exemplary submunition 12 hits the air stream at deployment, the spring retainer pin 64 and the safety lockout pin 46 are released out of their predeployment positions by the unfurling of the stabilizer ribbon or a secondary ribbon. The pins 46, 64 may otherwise be released by alternative known approaches. As is readily understood by a skilled artisan, this releases the compression spring 62 and removes the lockout from the delay mechanism 24.

Figure 6B:
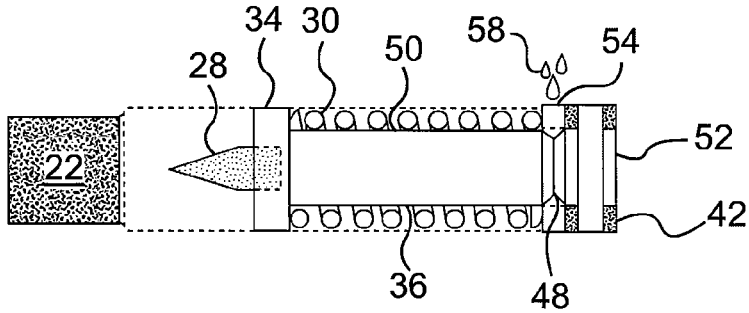
FIG. 6B is another side sectional view of the delay mechanism at a second state.

Upon its release, the compression spring 62 drives the ampoule weight 60 into the container 56, breaking the container and releasing the reactant fluid 58 to flow into and be absorbed by the felt wick 54. To help facilitate the flow of the released fluid 58 to the wick 54, a channel is provided therebetween and preferably the ampoule weight 60 acts as a plunger and pushes the fluid through the channel to the wick. In other words, after breaking the container 56, the compression spring 62 continues to drive the ampoule weight 60, forcing the fluid 58 into the wick 54. At this time, the delay mechanism 24 appears as depicted in FIG. 6B; with the safety lockout pin 46 removed and the reactant fluid 58 flowing towards the wick 54.

Figure 6C:
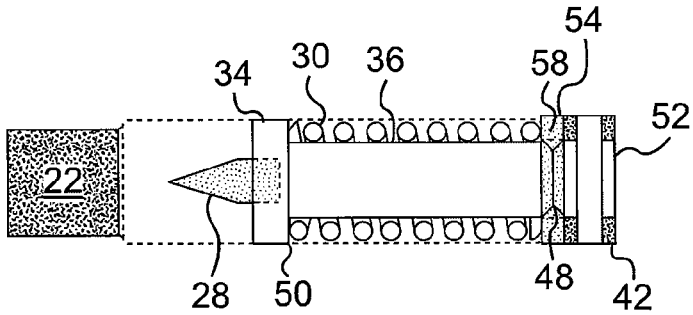
FIG. 6C is yet another side sectional view of the delay mechanism at a third state.
Figure 6D:
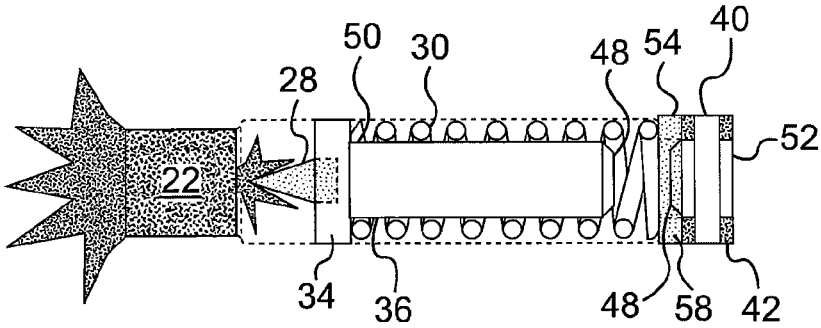
FIG. 6D is still another side sectional view of the delay mechanism at a fourth state.

The wick 54 encircles the weakened area 48 of the restraining link 26 allowing the reactant fluid 58 (e.g., activation liquid) to communicate with and attack (e.g., corrode) the axial rod 36 at the weakened area 48. FIG. 6C depicts the delay mechanism 24 with the wick 54 saturated with the fluid 58 that communicates with and attacks the axial rod 36. Over a predetermined minimum time delay (e.g., between about 25 seconds and 30 minutes) the axial rod 36 weakens to the point of failure and breaks, preferably at or about the weakened area 48. Upon the failure of the axial rod 36, the compression spring 30 drives the secondary firing pin 28 toward the secondary detonator 22, causing the firing pin to impact and explode the secondary detonator. See FIG. 6D, which depicts the delay mechanism 24 at impact with the secondary detonator 22 after the failure of the axial rod 36.

Output from the exploded secondary detonator 22 initiates the adjacent primary detonator 18, causing it to explode and sterilize the submunition. If at this time the fuze slide 16 is in its armed position, such that the primary detonator 18 is aligned with the main charge, then the initiation of the primary detonator from the secondary detonator 22 will then fire the submunition 12. Accordingly, the SD fuze delay device 10 is reliable since it ensures either sterilization or destruction of the submunition 12 depending on the relationship between the primary detonator 18 and the main charge.

FIGS. 7-13 depict a preferred embodiment of the self-destruct fuze delay mechanism. The drawings of the preferred embodiment exemplified in FIGS. 7-13 and in the embodiment exemplified in FIGS. 1-6 include like referenced numerals which designate like elements and which may not be further described to avoid unnecessary repetition.

Figure 7:
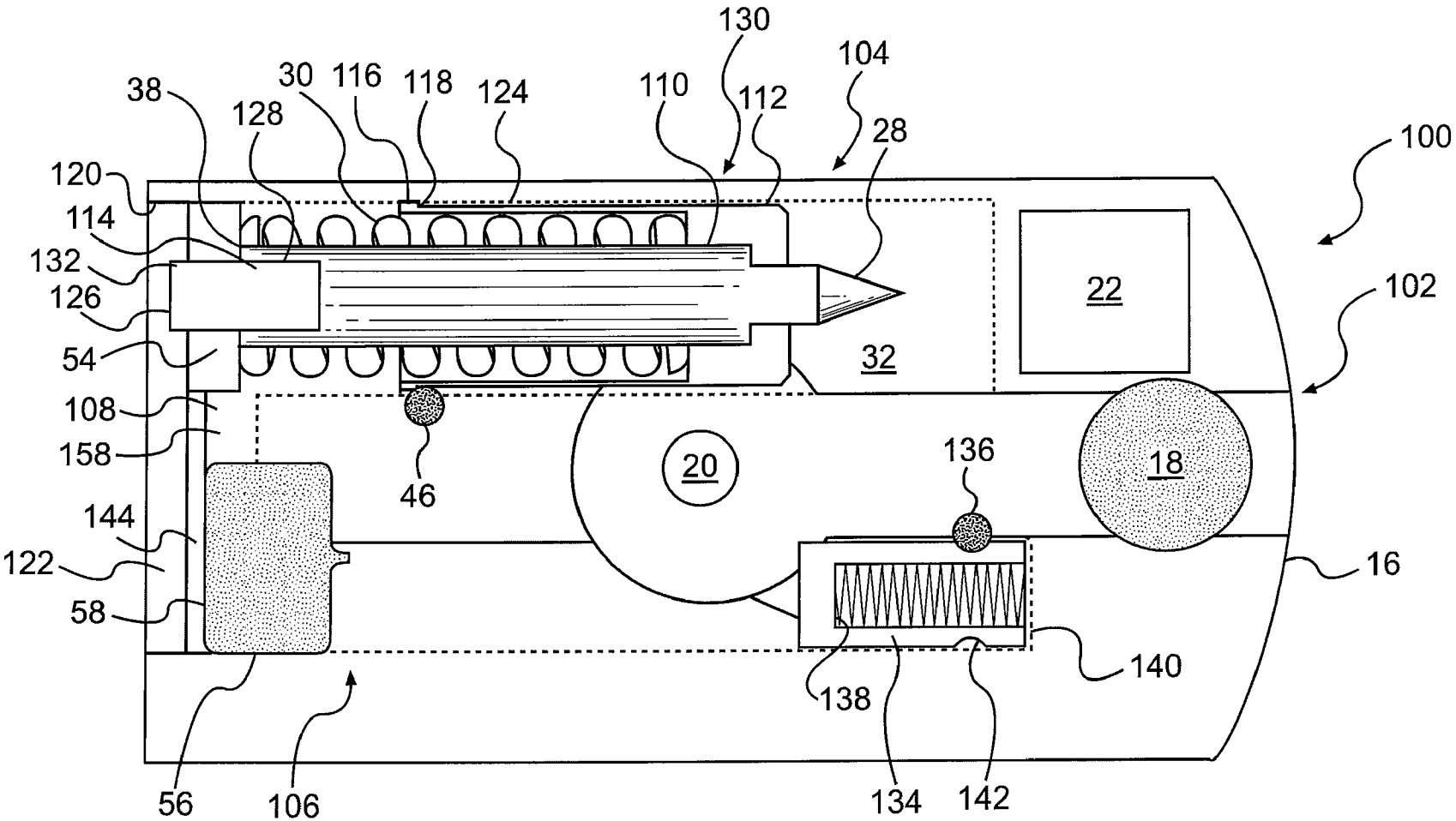
FIG. 7 is a top sectional view of another preferred embodiment of the self-destruct fuze delay device.

FIG. 7 shows an exemplary self-destruct fuze delay device 100 as a detonating fuze 102 for use with a submunition. Like the delay device 10 discussed above, the delay device 100 is housed in a fuze slide 16 having a primary detonator 18 that is movable with the fuze slide between a safety position (shown), where the primary detonator is not aligned with a main striker 20, and an armed position, where the primary detonator is adjacent the main striker and preferably aligned along the longitudinal axis of the submunition with the main striker. The delay device 100 includes a secondary detonator 22 aligned with a delay mechanism 104 that is arranged in the fuze slide 16 offset and substantially orthogonal to the longitudinal axis of the submunition. The delay device 100 also includes an activation mechanism 106 offset and in fluid communication with the delay mechanism 104 for activating the delay mechanism and causing the secondary detonator 22 to explode. While not being limited to a particular theory, the fuze slide 16 shown in FIG. 7 houses the secondary detonator 22, the delay mechanism 104 and the activation mechanism 106 in a generally U-shaped aperture 108 bored into the fuze slide and defined by an inner wall 120 of the fuze slide. The fuze slide 16 includes a closure plate 122, preferably formed of a plastic or metal, that is bonded (e.g., by adhesives, crimping, friction, heat) to the inner wall 120 defining the aperture 108 to seal the secondary detonator 22, the delay mechanism 104 and the activation mechanism 106 within the aperture.

As noted above, the explosion of the secondary detonator 22 activates the primary detonator 18, causing it to explode and set off the main charge if the primary detonator is aligned therewith. Preferably, the secondary detonator 22 remains adjacent the primary detonator 18 regardless of the position of the primary detonator to ensure that output from an explosion of the second detonator initiates the primary detonator. This ensures one of the previously discussed potential outcomes upon dispersion of the submunition into the atmosphere.

Still referring to FIG. 7, the delay mechanism 104 includes a compression spring 30 as an energizing source, and a restraining link 114 extending from the closure plate 122 to a secondary firing pin 28. The secondary or self-destruct firing pin 28 defines a front end of an axial rod 110 proximate the secondary detonator 22. The axial rod 110 is movable in a receptacle or channel 32 of the slide 16, and includes the secondary firing pin 28 and a piston 112 abutting a compression spring 30 as set forth in greater detail below.

The axial rod 110 extends away from the secondary detonator 22 from the secondary firing pin 28, freely passes inside the compression spring 30 and is attached at its distal end 38 to the closure plate 122 of the fuze slide 16 via the restraining link 114 as set forth in greater detail below. The axial rod 110 and compression spring 30 are partially embedded in a cylindrical sleeve 124 of the piston 112, which extends away from the secondary firing pin 28 to form the cylindrical sleeve having a central bore that partially houses the axial rod and compression spring 30 therein. The compression spring 30 is mounted in a compressed state around the axial rod 110 and is positioned between the piston 112 and the closure plate 122 of the fuze slide 16 to urge the piston, and thus the axial rod and the secondary firing pin 28 toward the secondary detonator 22. As can best be seen in FIG. 7, the cylindrical sleeve 124 terminates at a flanged rim 116 extending radially outward to define a shoulder 118. Before deployment, as shown in FIG. 7, the shoulder 118 abuts a safety lockout pin 46 that slides through a transverse opening in the fuze slide 16 and prevents movement of the secondary firing pin 28 towards the secondary detonator 22.

While not being limited to a particular theory, the restraining link 114 holds the axial rod 110 to the closure plate 122. The restraining link 114 is preferably a styrene based (e.g., polystyrene) shaft embedded and sealed (e.g., adhesively, frictionally) to aligned counter bores 126, 128 in the closure plate 122 and the axial rod 110, respectively. As such, the restraining link 114 is a weakened area that fails under chemical attack and breaks to release the firing pin and axial rod 110 from the closure plate 122. When broken, the restraining link 114 separates into two sections, which define adjacent edges of first and second portions 130, 132 of the restraining link. The first portion 130 is attached to the axial rod 110 which is attached to the secondary firing pin 28. The second portion 132 is distal or away from the secondary firing pin 28 and is attached to the closure plate 122.

Figure 11:
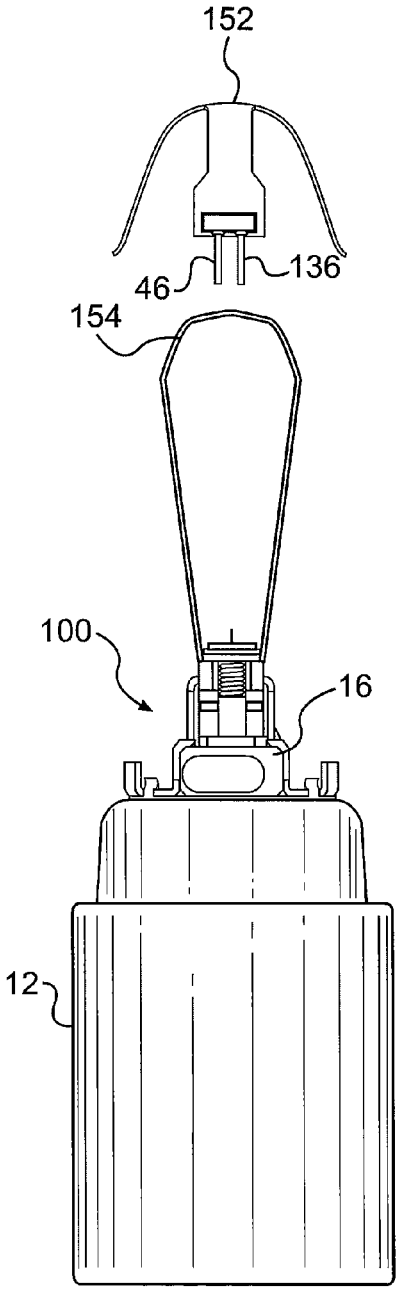
FIG. 11 is a side view of the exemplary fuze delay device shown in FIG. 8 after deployment.
Figure 12:
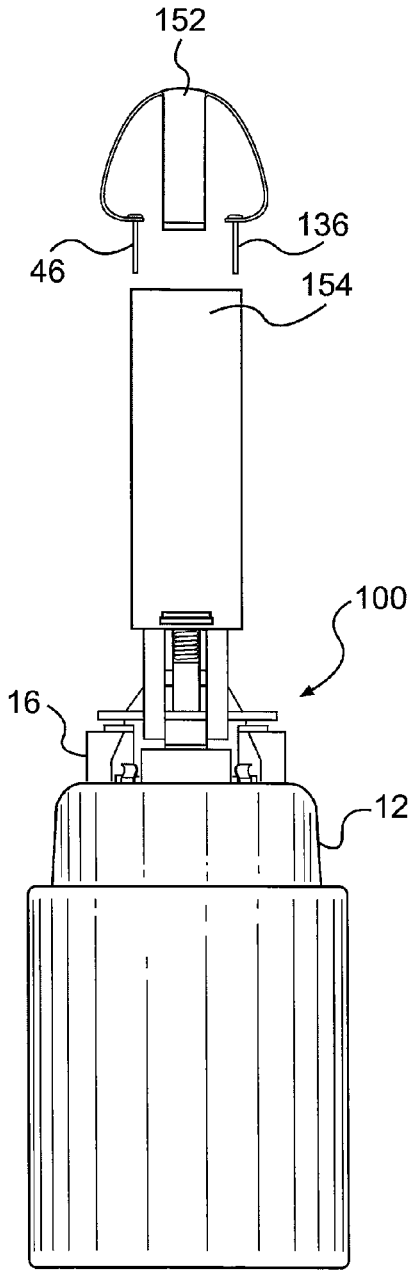
FIG. 12 is a side view of the exemplary fuze delay device shown in FIG. 9 after deployment.

The restraining link 114 is constructed of a material vulnerable to a reactant (e.g., corrosive agent, acid, solution), in particular, in comparison to the other elements of the delay mechanism 104 discussed above, to fail over time under application of the reactant. While not being limited to a particular theory, the reactant erodes the restraining link 114, causing the restraining link fail or break under the pulling stress of the compression spring 30 and release the first portion 130 toward the secondary detonator 22 (FIG. 11). Furthermore, a wick 54 is positioned adjacent, and preferably encircles the restraining link 114 between the axial rod 110 and the closure plate 122. The wick 54 is made of a porous material that absorbs and directs the reactant fluid 58 to the restraining link 114 to facilitate the erosion and failure of the restraining link, as described, for example, in greater detail below. It should be understood that the wick 54 is not critical to the operation of the fuze delay device 100, as the use of the wick is not required for the reactant fluid 58 to access and erode the restraining link to failure. However, the use of the wick 54 or an equivalent thereto is preferred to direct and focus the reactant fluid 58 onto the restraining link 114 for improved control and uninterrupted communication there between.

Still referring to FIG. 7, after deployment and a subsequent delay, the activation mechanism 106 activates the delay mechanism 104 by releasing the first portion 130 of the restraining link 114 from the second portion 132, which allows the compression spring 30 to urge the secondary firing pin 28 to the secondary detonator 22. While not being limited to a particular theory, the activation mechanism 106 is offset from the channel 32 that houses the delay mechanism 104. The activation mechanism 106 includes a container 56 (e.g., glass ampoule) holding a reactant fluid 58. The reactant fluid 58 is a corrosive agent (e.g., acid or solution of liquid or gas) that when placed in contact with the restraining link 114, chemically attacks and causes the restraining link to erode, fail and break, thereby allowing the compression spring 30 to separate and move the axial rod 110 and the secondary firing pin 28 toward and activate the secondary detonator 22.

The activation mechanism 106 also includes an ampoule breaker 134, a compression spring 62 and a spring retainer pin 136. As shown in FIG. 7, the ampoule breaker 134 and compression spring 62 are aligned with at least a portion of the container 56 in a channel 142 of the fuze slide 16 offset from the channel 32. The compression spring 62 is an energizing source mounted in a tension state inside the ampoule breaker 134 between an inner wall 138 of the ampoule breaker and an inner wall 140 of the slide 16. The spring retaining pin 136 is inserted into the fuze slide 16 and abuts a groove 142 of the ampoule breaker 134 to hold the ampoule breaker in a locked position away from the container 56 as shown, for example, in FIG. 7. When inserted into the fuze slide 16 as shown, the spring retaining pin 136 keeps the compressed spring 62 in its tensioned state, and thereby keeps the container 56 safe from impact by the ampoule breaker 134. Therefore, the inserted spring retainer pin 136 prevents activation of the SD fuze delay device 100.

Like the ampoule weight 60 described above, the ampoule breaker 134 is a breaking member that, but for the spring retainer pin 136, is urged by the compression spring 62 into impact with the container 56, causing the container to break and release the reactant fluid 58. In addition to breaking the container 56, the ampoule breaker 134 also preferably acts as a plunger and pushes the released fluid 58 toward the delay mechanism 104 whereupon the fluid corrodes the restraining link 114 to release the secondary firing pin 28 toward the secondary detonator 22 (FIG. 11).

In a preferred embodiment, such as exemplified in FIG. 7, the fuze delay device 100 also includes a cushion pad 144 between the container 56 and the closure plate 122. The cushion pad 144 is preferably a resilient member that serves as a cushion to the container 56 before the container is broken by the ampoule breaker 134. Submunitions 12 are subject to a range of vibrations, rattles and forces before deployment, for example during loading and transportation, which transfer to the elements inside the submunition. Since the container 56 is breakable, it is beneficial to include a cushion pad 144 adjacent the container to absorb the vibrations and prevent the container from moving and breaking prematurely. Accordingly, the cushion pad 144 is not required for the operation of the invention, but is helpful to protect the container 56.

Figure 9:
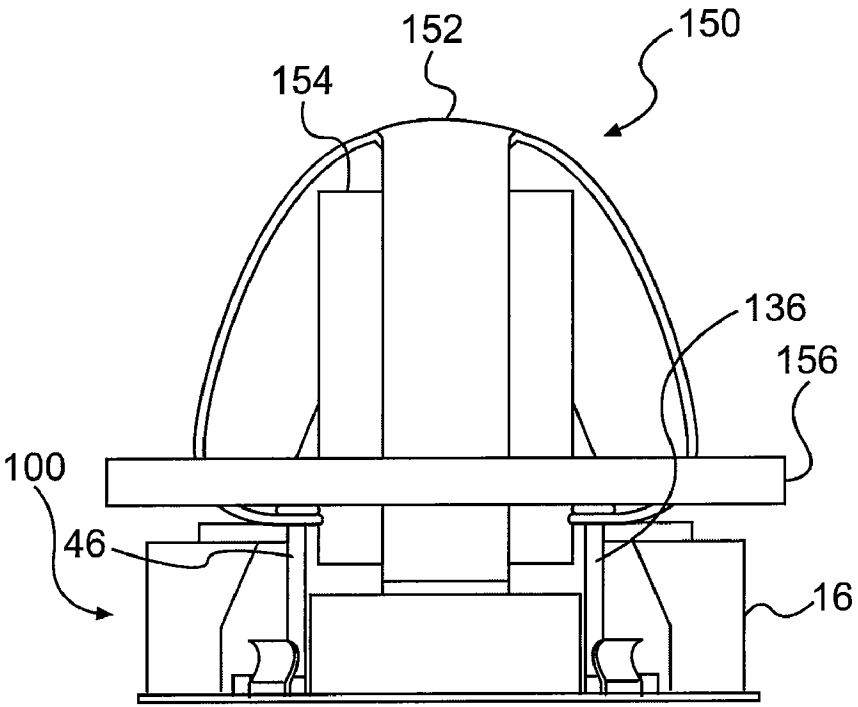
FIG. 9 depicts the fuze device shown in FIG. 8 from a side view substantially orthogonal to the view of FIG. 8.
Figure 8:
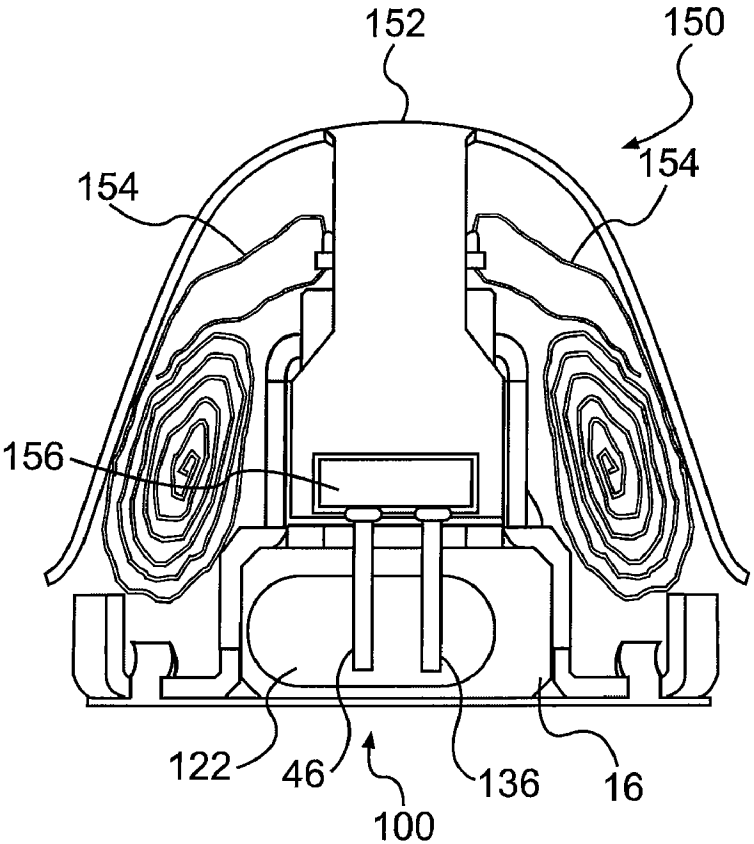
FIG. 8 is a side view partially in section of an exemplary fuze delay device before deployment into the atmosphere.

The self-destruct fuze delay device 100 self-destructs the submunition 12 after a preset delay if the submunition fails to explode upon its impact with the ground or a target. FIG. 8 depicts an exemplary fuze assembly 150 for the submunition 12 in a side view partially in section, before deployment into the atmosphere. FIG. 9 depicts the fuze assembly 150 viewed from a side substantially orthogonal to the side view of FIG. 8. The fuze assembly 150 includes the fuze delay device 100 mountable on a submunition 12, a ribbon retainer 152 and a stabilizer ribbon 154. The ribbon retainer 152 is attached to the safety lockout pin 46 and the spring retainer pin 136, both of which are shown inserted into the fuze slide 16 to hold the secondary firing pin 28 and the ampoule breaker 134 in their respective locked positions as shown, for example, in FIG. 7. The ribbon retainer 152 also prevents premature unfurling of the stabilizer ribbon 154 as is well known to those skilled in the art. The fuze assembly 150 is shown in FIGS. 8 and 9 as having a safety spacer 156 that is a known in-process safety device for blocking the firing pin from engaging the primary detonator 18 during the assembly of the fuze assembly. The safety spacer 156 is removed from the fuze assembly 150 before the submunitions 12 are stacked or otherwise loaded into their carrier.

Figure 10:
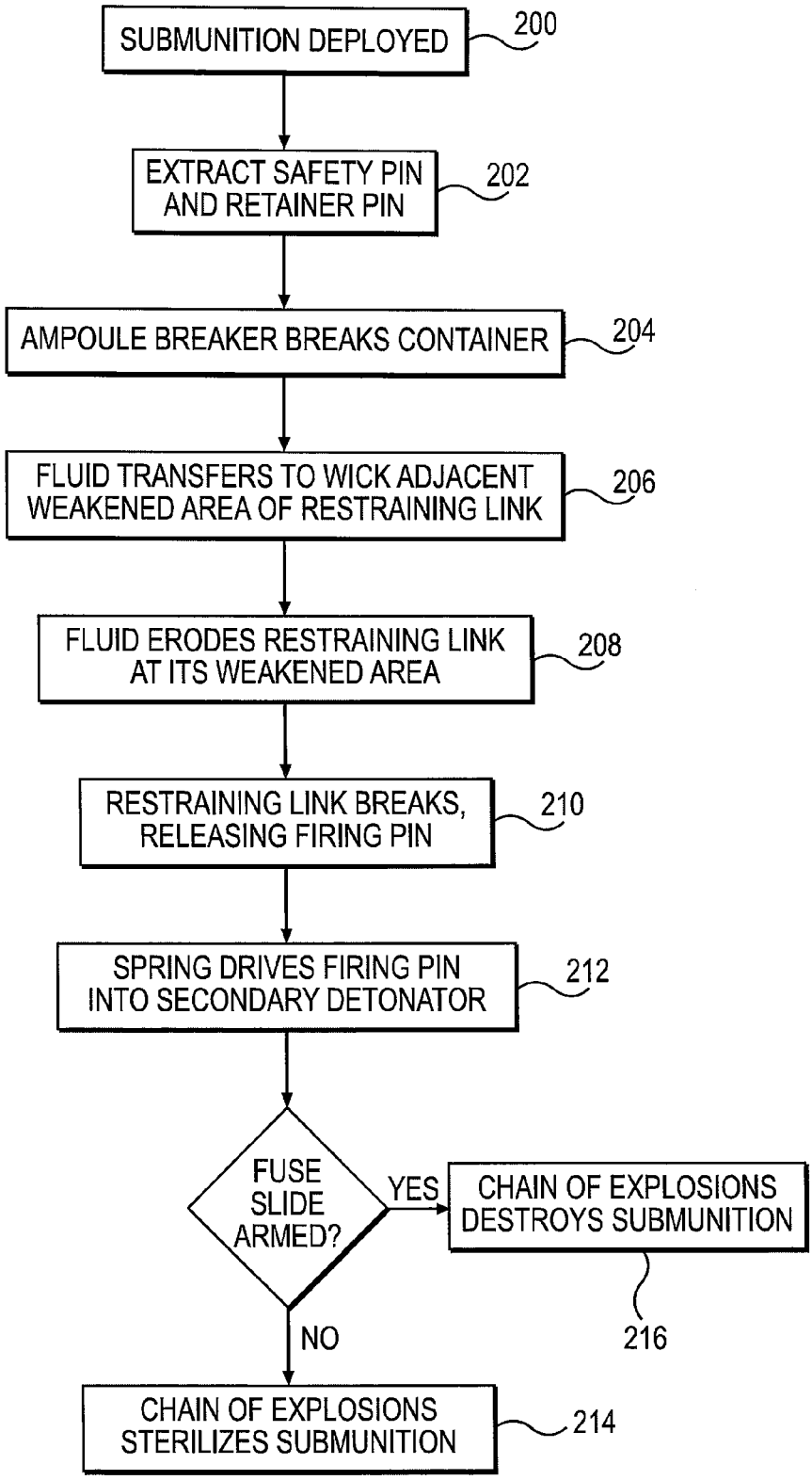
FIG. 10 is a flow diagram depicting an exemplary function sequence of events for the self-destruct fuze delay device of the preferred embodiments.

FIG. 10 is a flow diagram depicting an exemplary function sequence of events for the self-destruct fuze delay device 100 of the preferred embodiments. When an exemplary submunition 12 hits the air stream at deployment (Step 200), the spring retainer 10, 136 and the safety lockout pin 146 are released out of their predeployment positions by the unfurling of the stabilizer ribbon 154. In other words, upon deployment, atmospheric wind resistance against the submunition 112 separate the ribbon retainer 152 from the submunition, extracting the spring retainer pin 136 and the safety lockout pin 146 out to their predeployment positions by the unfurling of the stabilizer ribbon 154 at Step 202. As can be seen in the corresponding side views of FIGS. 11 and 12, the ribbon retainer's separation from the submunition 12 extracts the spring retainer pin 136 and the safety lockout pin 46 as the ribbon retainer 152 separates. The safety and retainer pins 46, 136 may otherwise be extracted from the fuze delay device 100 by alternative approaches, and the manner in which the pins are released from the fuze delay device is not critical to the operation of the invention.

The extraction of the safety lockout pin 46 removes the lockout from the delay mechanism 104, and the extraction of the spring retainer pin 136 releases the compression spring 62. Upon its release at Step 204, the compression spring 62 drives the ampoule breaker 134 into the container 56, breaking the container and releasing the reactant fluid 58 to flow to the restraining link 114, preferably via the wick 54. To help facilitate the flow of the released fluid 58 to the wick 54 and restraining link 114, a liquid passage 158 within the aperture 108 is provided therebetween.

Figure 13:
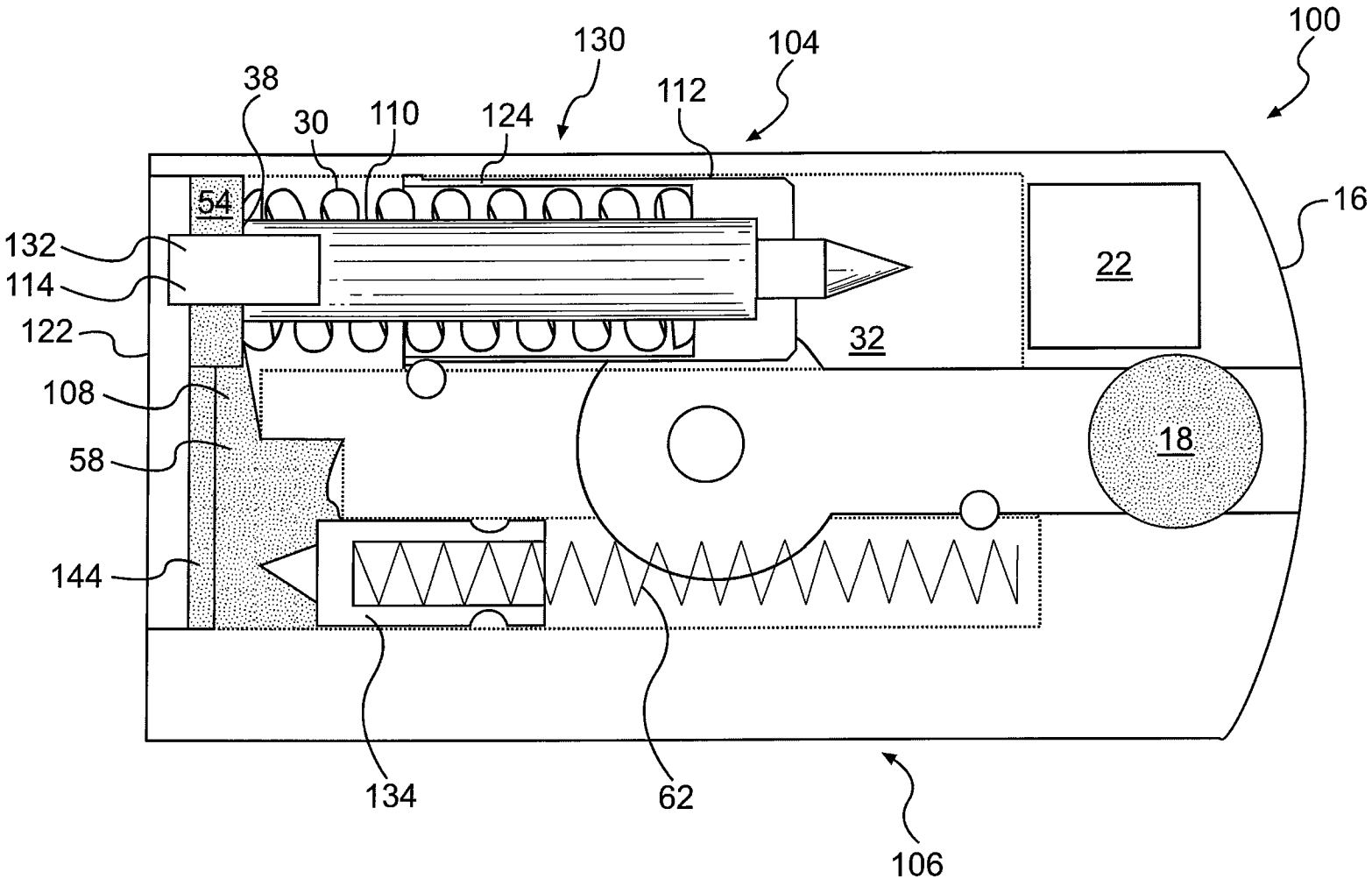
FIG. 13 is a top sectional view of the exemplary fuze delay device of FIG. 7 after breaking of the reactant container.

As can best be seen in FIG. 13, after the ampoule breaker 134 breaks the container 56, the ampoule breaker continues to push beyond its impact point with the container 56. In this manner, the ampoule breaker 134 acts as a plunger and pushes the fluid 58 through the liquid passage 158 to the wick 54 and restraining link 114. In other words, after breaking the container 56, the compression spring 62 continues to drive the ampoule breaker 134, forcing the fluid 58 through the liquid passage 158 and into the wick 54 at Step 206. The fluid 58 is absorbed by the wick 54 and communicates with the restraining link 114. At this time, the detonating fuze 102 appears as can best be seen, for example, in FIG. 13 with the ampoule breaker 134 extended, the container 56 ruptured, and the wick 54 saturated by the reactant fluid 58. FIG. 13 also shows the cushion pad 144 saturated with the reactant fluid 58, which is not important to the invention, but is instead a byproduct of the fluid exposed to the resilient cushion pad.

The wick 54 encircles an area (e.g., weakened area) of the restraining link 114, and directs the reactant fluid 58 to access and attack (e.g., erode, corrode) the restraining link at Step 208. Preferably the fluid 58 erodes the restraining link in contact with the wick 54. In other words, the axial rod 110, the piston 112, the compression spring 30 and the secondary firing pin 28 are preferably made of metal and not vulnerable to erosion by the reactant fluid 58.

At Step 210, over a predetermined time period (e.g., between about 25 seconds and 30 minutes the restraining link 114 exposed to the reactant fluid 58 weakens to a point of failure and breaks, thus defining the first and second portions 130, 132. The predetermined time period typically varies in accordance with several factors, for example, the composition of the reactant fluid, the density of the restraining link and the ambient temperature, as would be readily understood by a skilled artisan. For example, at cold temperatures of about −25° F., the restraining link fails at about 20 to 29 minutes. Of course the failure time decreases as the temperature increases.

Figure 14:
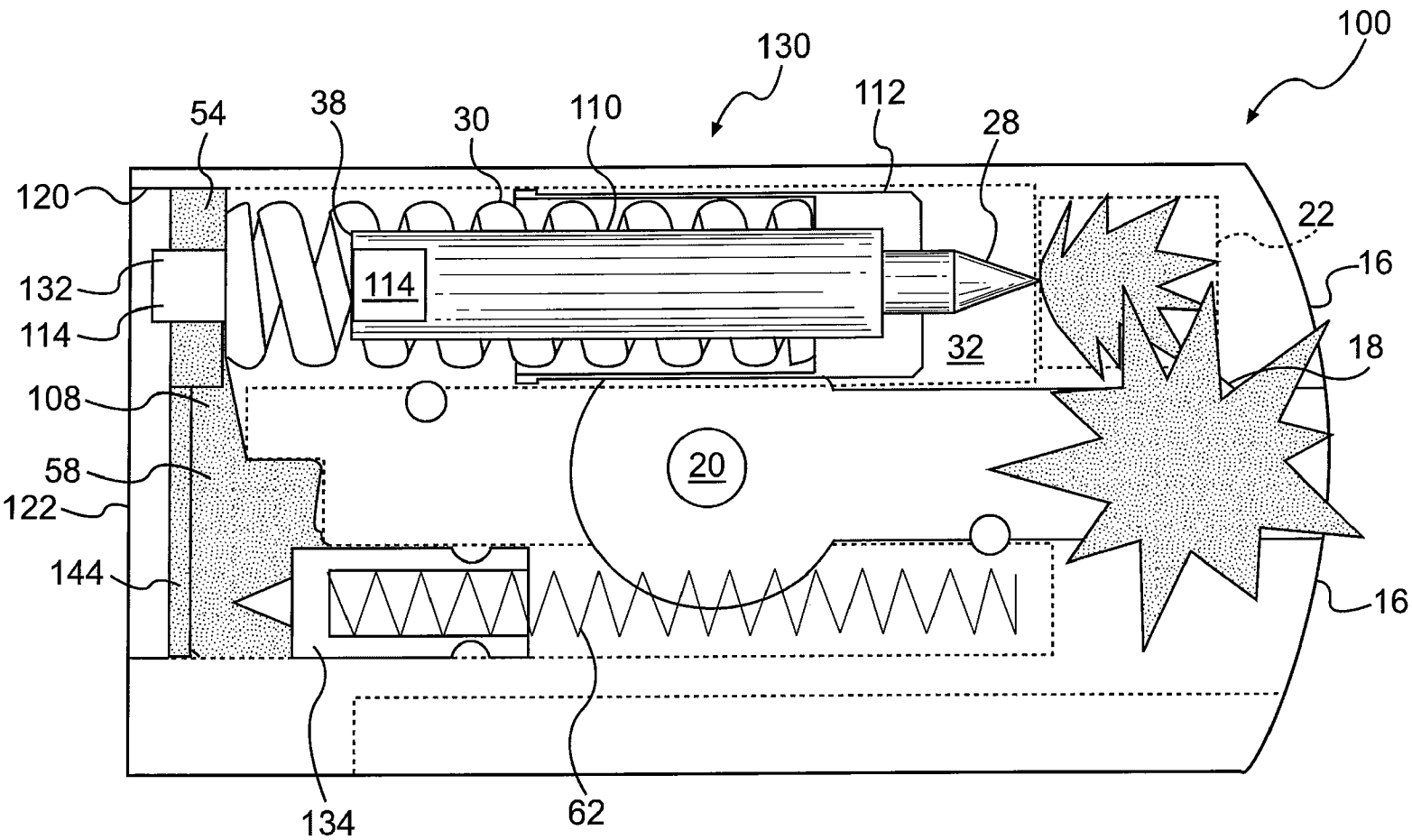
FIG. 14 is a top sectional view of the exemplary fuze delay device of FIG. 13 after separation of the restraining link.

Upon the failure of the restraining link 114 at Step 212, the compression spring 30 drives the first portion 130 of the restraining link 114, the piston 112, the axial rod 110 and the secondary firing pin 28 toward the secondary detonator 22, causing the secondary firing pin to impact and explode the secondary detonator 22. See, for example, FIG. 14, which depicts the secondary firing pin 28 at impact with the secondary detonator 22 after the failure of the restraining link 114. While the restraining link 114 shown in FIG. 14 is separated adjacent the axial rod 110, it is understood that the failure of the restraining link occurs at its weakened area preferably adjacent the wick 54. In FIG. 14, the weakened area of the restraining link 144 extends within the wick 54 between the axial rod and the closure plate 122.

As can best be seen in FIG. 14, at Step 214 output from the exploded secondary detonator 22 initiates the adjacent primary detonator 18, causing it to explode and sterilize the submunition when the fuze slide 16 is not armed. However, if at this time the fuze slide 16 is in its armed position, such that the primary detonator 18 is aligned with the main charge, then at Step 216 the initiation of the primary detonator from the secondary detonator 22 will then fire the main charge and destroy the submunition 12 (e.g., grenade, missile, rocket warhead munition). Accordingly, the self-destruct fuze delay device 100 also ensures sterilization or destruction of the submunition 12 depending on the relationship between the primary detonator 18 and the main charge.

FIGS. 15-23 depict another preferred embodiment of the self-destruct fuze delay mechanism. The drawings of the preferred embodiment exemplified in FIGS. 15-23 and in the embodiments exemplified in FIGS. 1-14 include like referenced numerals which designate like elements and which may not be further described to avoid unnecessary repetition.

Figure 15:
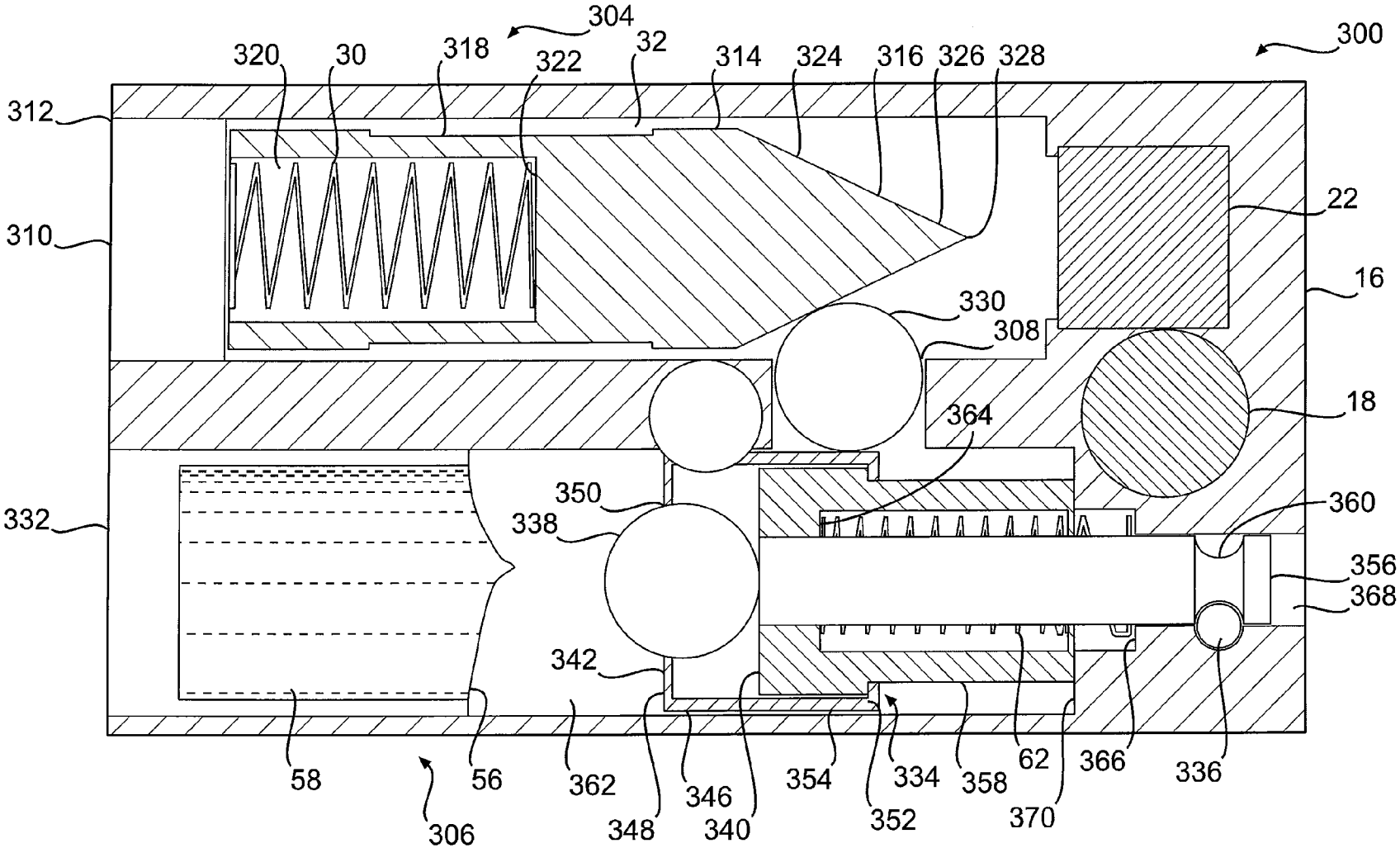
FIG. 15 is a top sectional view of yet another exemplary self-destruct fuze delay device according to the preferred embodiments.
Figure 16:
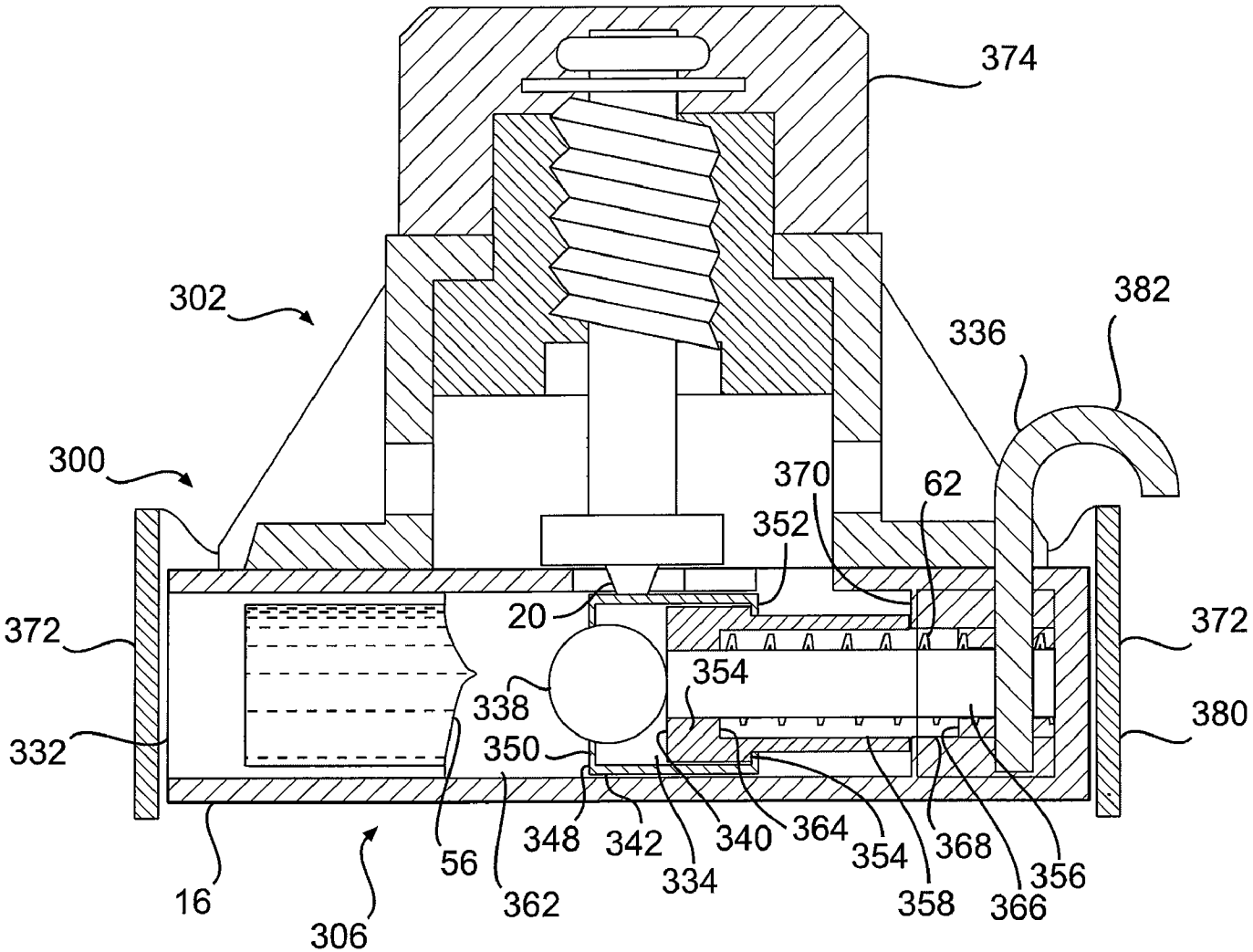
FIG. 16 depicts the fuze device shown in FIG. 15 from a side sectional view.

FIGS. 15 and 16 show a top view and aside view, respectively, and partially in section, of an exemplary self-destruct fuze delay device 300, which includes a fuze assembly 302 for use with a submunition. Like the delay devices 10 and 100 discussed above, the delay device 300 is housed in a fuze slide 16 having a primary detonator 18 that is movable with the fuze slide between a safety position where the primary detonator is not aligned with a main striker 20, and an armed position (not shown), where the primary detonator is adjacent the main striker and preferably aligned with the main striker along the longitudinal axis of the submunition. The delay device 300 includes a secondary detonator 22 aligned with a delay mechanism 304 that is arranged in the fuze slide 16 offset and substantially orthogonal to the longitudinal axis of the submunition. The fuze slide 16 also includes a closure plug 310, preferably formed of a plastic or metal, that is bonded (e.g., by adhesives, crimping, friction, heat) to an inner wall 312 of the fuze slide to seal the secondary detonator 22 and the delay mechanism 304 within the aperture.

The delay device 300 further includes an activation mechanism 306 offset and in communication with the delay mechanism 304 via a first channel 308. After deployment and a subsequent delay typically resulting from the failure of an armed submunition, the activation mechanism 306 activates the delay mechanism 304, which causes the secondary detonator 22 to explode. As noted above, the explosion of the secondary detonator 22 activates the primary detonator 18, causing it to explode and set off the main charge if the primary detonator is aligned therewith. Preferably, the secondary detonator 22 remains adjacent the primary detonator 18 regardless of the position of the primary detonator to ensure that output from an explosion of the secondary detonator initiates the primary detonator. This ensures one of the previously discussed potential outcomes upon dispersion of the submunition into the atmosphere.

Still referring to FIGS. 15 and 16, the delay mechanism 304 includes a compression spring 30 as an energizing source, and a secondary firing pin 314. The secondary firing pin 314 is a self-destruct firing pin, and includes a front end 316 proximate the secondary detonator 22, and a cylindrical sleeve 318 that extends toward the closure plug 310. The front end 316 includes a cone shaped portion 324 having a sloped wall 326 terminating at a tip 328. The cylindrical sleeve 318 has a hollow portion 320 that terminates at a wall 322 and at least partially houses a compression spring 30. While not being limited to a particular theory, the secondary firing pin 314 is movable in a receptacle or second channel 32 of the slide 16 that is at least partially defined by the inner wall 312 and surrounds the secondary firing pin 314, the compression spring 30 and the closure plug 310.

The compression spring 30 is mounted in a compressed state between the wall 322 of the secondary firing pin 314 and the closure plug 310 of the fuze slide 16 to urge the secondary firing pin toward the secondary detonator 22. Before deployment, the sloped wall 326 abuts an interlock ball 330 aligned within the first channel 308 in the fuze slide 16. As can best be seen in FIG. 16, before deployment the interlock ball 330 extends into the second channel 32 and engages the sloped wall 326 to prevent movement of the secondary firing pin 314 towards the secondary detonator 22. The interlock ball 330 is a restraining unit or link coupled to the secondary firing pin 314 that prevents a premature collision of the secondary firing pin with the secondary detonator 22 while the interlock ball is supported against the sloped wall 326 by an ampoule breaker 334, as is described in greater detail below. Preferably the interlock ball 330 is formed of a hard material, such as steel or other metal, and can withstand the forces inherently applied by the compression spring 30 and secondary firing pin 314.

While not being limited to a particular theory, the activation mechanism 306 is located in a third channel 362 offset from the second channel 32 that houses the delay mechanism 304. The activation mechanism 306 includes a glass ampoule as a container 56 that holds a reactant fluid 58. The reactant fluid 58 is a corrosive agent (e.g., acid or liquid solution) that chemically attacks and causes certain materials (e.g., hard plastics) to erode over time. Preferably the glass ampoule is partially housed in a generally cup-shaped resilient insulator 332 that is preferably not susceptible to the reactant fluid so that the reactant fluid 58 does not erode the container 56. The insulator 332 also provides a benefit similar to the closure plug 310, since the insulator seals the container 56 and other elements of the activation mechanism 306 within the slide 16. Since the container 56 is breakable, it is beneficial to include the insulator 332 about the container to absorb the vibrations and prevent the container from moving and breaking prematurely. Accordingly, the insulator 332 is not required for the operation of the invention, but is helpful to protect the container 56.

The activation mechanism 306 further includes the ampoule breaker 334, a compression spring 62 and an activation pin 336. Like the ampoule weight 60 and the ampoule breaker 134 described above in other preferred embodiments, the ampoule breaker 334 is a breaking member that, but for the activation pin 336, is urged by the compression spring 62 into impact with the container 56, causing the container to break and release the reactant fluid 58.

The ampoule breaker 334 is a breaking member that includes a timing ball 338 and a piston 340 held in contact by a clamp 342. The clamp 342 is made of metal or other hard material that preferably is at least substantially impervious to erosion by the reactant fluid 58. As can be seen, for example, in FIGS. 15 and 16, the clamp 342 holds the timing ball 338 and the piston 340 together while also allowing the piston to slide within the clamp during the self destruct fuze delay sequence, as will be discussed in greater detail below. While not being limited to a particular theory, the clamp 342 includes a hollow cylindrical body 346 with supporting walls depending radially inward from the body to keep the timing ball 338 and the piston 340 together and to eventually allow the piston to move within the clamp. In particular, a first supporting wall 348 extends inward to define an aperture 350 having a diameter slightly less than the pre-deployment diameter of the timing ball 338, so as to prevent passage of the timing ball through the aperture before deployment of the submunition. A second supporting wall 352 extends inwardly to abut a rear facing shoulder 354 of the piston 340 and hold the piston against the timing ball 338. Before and during deployment, the clamp 342 also abuts and supports the interlock ball 330 against the sloped wall 326 of the secondary firing pin 314, which holds the secondary firing pin in place preventing its movement toward the secondary detonator 22.

Referring to FIGS. 15 and 16, the piston 340 of the ampoule breaker 334 includes an axial rod 356 and a sleeve member 358 coupled together adjacent the timing ball 338. The axial rod 356 is inserted into a narrowed portion 368 of the third channel 362 until the sleeve member 358 abuts an inner wall 370 of the fuze slide 16. The axial rod 356 is generally cylindrical, and has a first end (within the narrowed portion 368) that is cut radially inwards to define an annular groove 360 adapted to house the activation pin 336. When inserted into the annular groove 360, as shown in FIG. 16, the activation pin 336 holds the axial rod 356 and keeps the ampoule breaker 334 separated from the container 56.

As noted above, the ampoule breaker 334 and compression spring 62 are aligned with the container 56 in the third channel 362 of the fuze slide 16 that is offset from the second channel 32 and in communication with the first channel 308. The compression spring 62 is an energizing source mounted in a compressed state inside the ampoule breaker 334 between an inner wall 364 of the sleeve member 358 and a shoulder 366 of the slide 16. When inserted into the fuze slide 16 as shown in FIGS. 15 and 16, the activation pin 336 keeps the compressed spring 62 in its tensioned state, and thereby keeps the axial rod 356 and thus the ampoule breaker 334 in a locked position away from the container 56. Therefore, the inserted activation pin 336 is a spring retainer that prevents activation of the SD fuze delay device 300 by keeping the container 56 safe from impact by the ampoule breaker 334. As will be described in greater detail below, removal of the activation pin 336 from the annular groove 360 releases the axial rod 356 for movement within the third channel 362.

The timing ball 338 is seated in the aperture 350 of the first supporting wall 348 and abuts the axial rod 356, as both the timing ball and the piston 340 are held together by the clamp 342. Initially, the timing ball 338 is sized and structurally hard enough to remain seated, that is, not slide through the aperture 350 when urged by the compression spring 62, and is sufficiently hard to impact and break the container 56. As discussed above, the container 56 (e.g., glass ampoule) is breakable upon collision with a projecting member, for example, the timing ball 338 when the timing ball is pushed into the container by the compression spring 62.

While not being limited to a particular theory, the timing ball 338 is both a part of the breaking member that breaks the container 56 upon collision, and a weakened area of the self destruct fuze delay device 300 that erodes under chemical attack and, after a delay, slips through the aperture 350 and allows the interlock ball 330 to release the secondary firing pin 314, as set forth in greater detail below. As such, the timing ball 338 is constructed of a material, preferably styrene (e.g., polystyrene) that is both hard enough to break glass and is vulnerable to the reactant 58 (e.g., corrosive agent, acid, solution). In particular, the timing ball 338 is vulnerable to the reactant 58, in comparison to the other elements of the activation mechanism 306 discussed above, to fail over time under application of the reactant. As can best be seen in FIGS. 20-23, the reactant 58 erodes the timing ball 338, changing the structure (e.g., size, shape, hardness, composition) of the ball until it pops through the aperture 350 under the expansion of the compression spring 62. It is also understood that the timing ball 338, while shown as a sphere, is not limited to that shape. It is more important that the timing ball 338 does not slide through the aperture 350 until after the delay required for the timing ball to erode to a structure that can slide through the aperture sufficiently to allow the interlock ball 330 to release the secondary firing pin 314.

Figure 17:
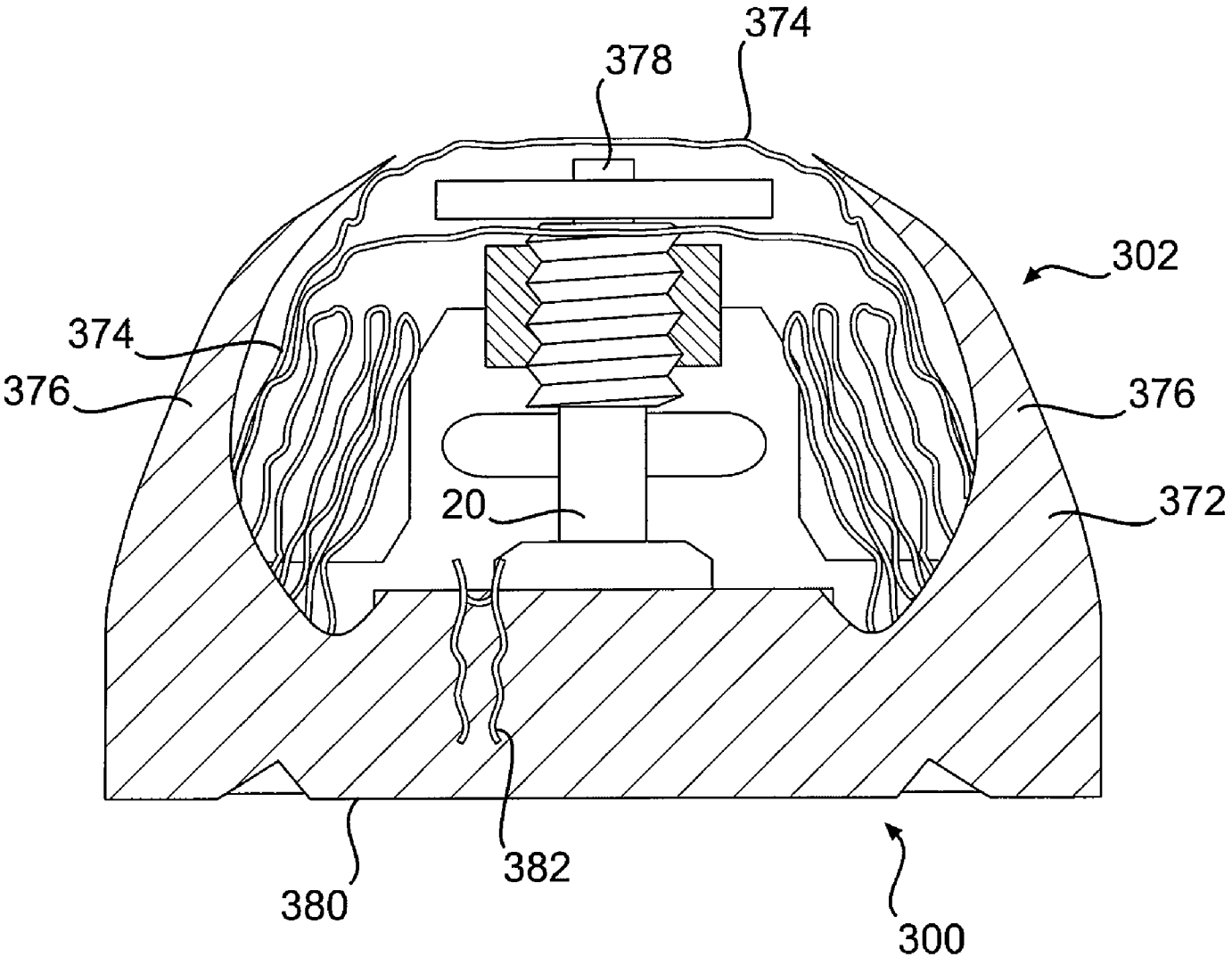
FIG. 17 is a side view partially in section of an exemplary fuze delay device before deployment into the atmosphere.
Figure 18:
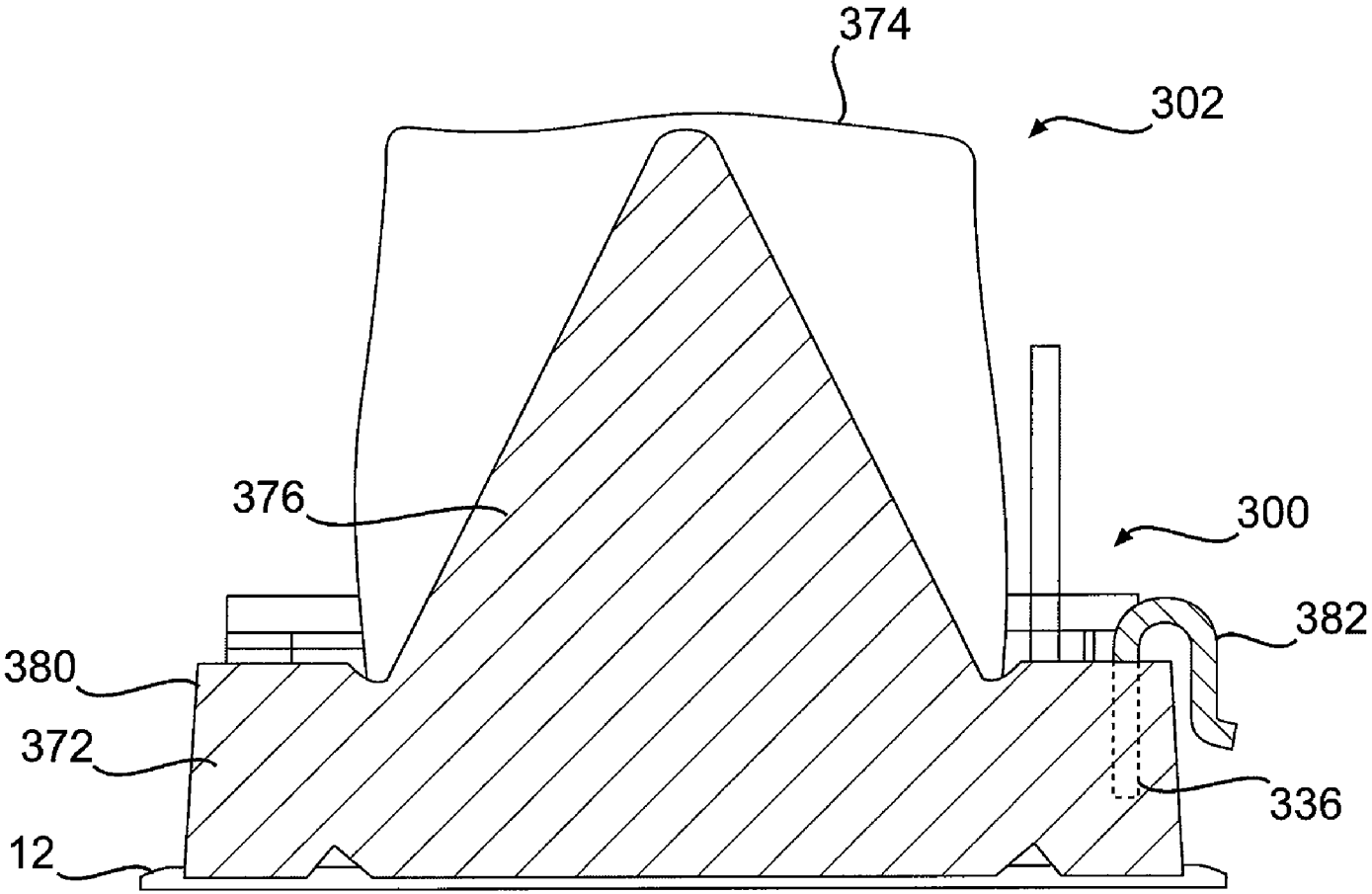
FIG. 18 depicts the fuze device shown in FIG. 17 from a side view substantially orthogonal to the view of FIG. 17.

The self-destruct fuze delay device 300 self-destructs the submunition 12 after a preset delay if the submunition fails to explode upon its impact with the ground or a target. FIGS. 17 and 18 depict the fuze assembly 302 with the self-destruct fuze delay device 300 in orthogonal side views partially in section, before deployment into the atmosphere. In particular, FIG. 17 depicts the self-destruct fuze delay device 300 from a first side view, and FIG. 18 depicts the fuze delay device from a second side view substantially orthogonal to the first side view of FIG. 17.

The fuze assembly 302 of the fuze delay device 300 is mountable on the submunition 12, and includes a ribbon retainer 372 and a stabilizer ribbon 374. The ribbon retainer 372 is preferably a thin plastic slide lock that holds both the stabilizer ribbon 374 and the fuze slide 16 in place prior to deployment of the submunition 12. That is, the ribbon retainer 372 prevents premature unfurling of the stabilizer ribbon 374, and also prevents premature movement of the fuze slide 16 from its safe position (as shown for example in FIG. 16) to its armed position where the primary detonator 18 is aligned with the main striker 20. While not being limited to a particular theory, the ribbon retainer 372 includes generally triangularly shaped extensions 376 that rise over the unfurled stabilizer ribbon 374 to hold the ribbon in place, and do not extend over the arming screw 378 of the main striker 20. Of course the extensions 376 could alternatively extend over the arming screw 378 if needed to aid in holding the unfurled stabilizer ribbon 372 or to provide additional structural integrity as desired. The ribbon retainer 372 also includes band strips 380 between the extensions 376 that sit about the fuze slide, preventing its movement prior to deployment.

As can be seen in FIGS. 16-18, the activation pin 336 includes a neck portion 382 that is bent to form a generally J-shaped hook. When inserted into the annular groove 360, as shown in FIGS. 15 through 18, the activation pin 336 holds the axial rod 356 and loops over the band strip 380 of the ribbon retainer 372. With the integration of the neck portion 382 over the band strip 380, the activation pin 336 may be extracted from the annular groove 360 by extracting the ribbon retainer 372 from the fuze slide 16. The ribbon retainer 372 extracts from the fuze slide 16, for example, as the stabilizer ribbon 374 unfurls upon deployment of the submunition 12.

While not being limited to a particular theory, the activation pin 336 may be structured as a single solid generally cylindrical shaft that is bent to form a hook. As an alternative, the activation pin 336 may be structured with more than one shaft strand (e.g., two shaft strands) similar to a bent hair pin. Forming the activation pin 336 with, for example, two shaft strands, allows the activation pin to be formed with less material and easily bent into shape. It is understood that the thickness and construction of the activation pin is not critical to the invention, as long as the pin works for its purpose of holding the axial rod 356 in places when inserted into the annular groove 360, and of being removable from the annular groove upon extraction by the ribbon retainer 372.

Figure 19:
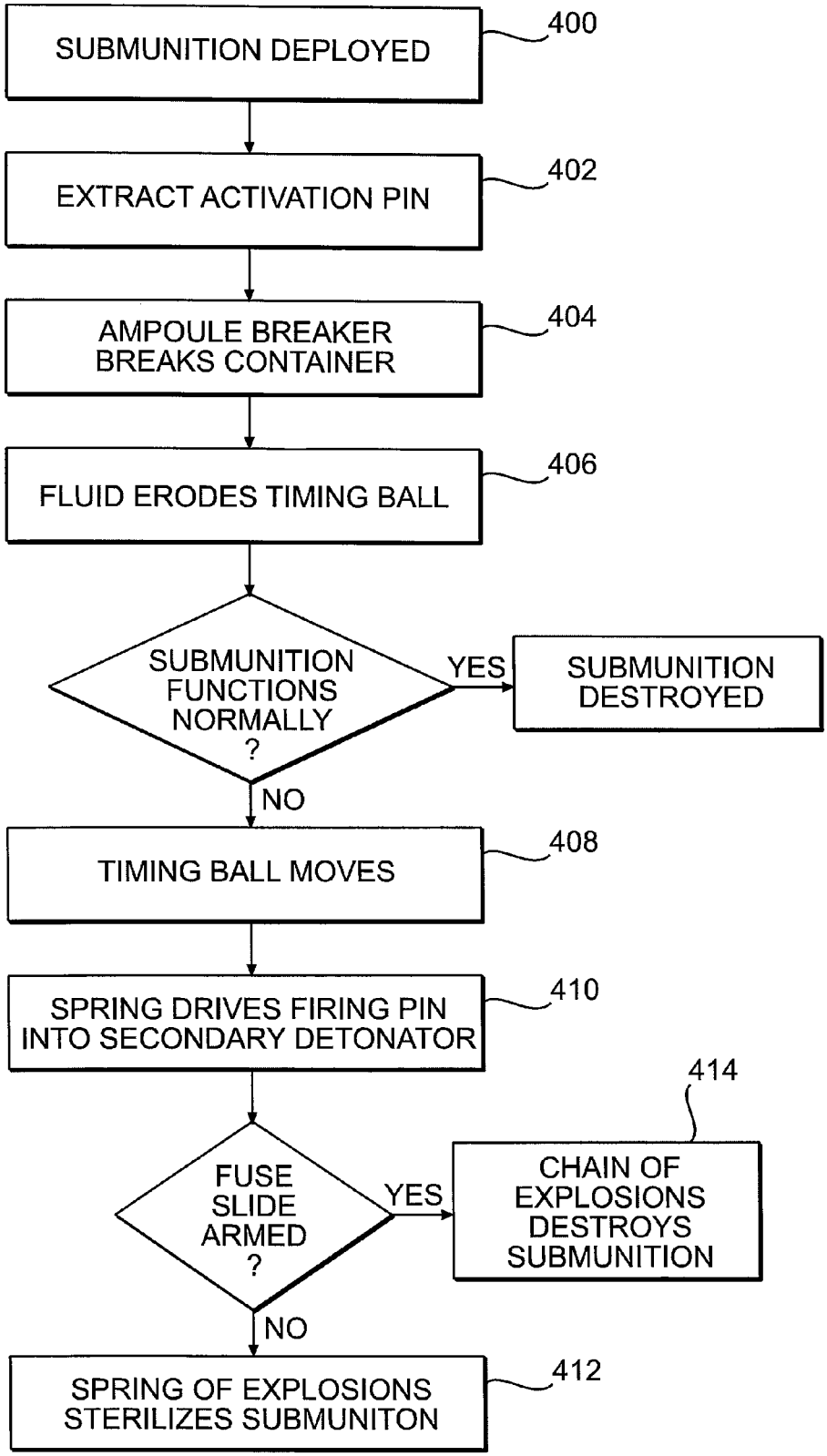
FIG. 19 is a flow diagram depicting another exemplary function sequence of events for the self-destruct fuze delay device of the preferred embodiments.

FIG. 19 is a flow diagram depicting an exemplary functional sequence of events for the self-destruct fuze delay device 300 of the preferred embodiments. When an exemplary submunition 12 having the self-destruct fuze delay device 300 hits the air stream at deployment (Step 400), the stabilizer ribbon 374 unfurls and extracts the ribbon retainer 372. At Step 402, the ribbon retainer 372 extracts the activation pin 336 from its pre-deployment position in the annular groove 360. In other words, upon deployment, atmospheric wind resistance against the submunition 12 separates the ribbon retainer 372 from the submunition, extracting the activation pin 336 out of its pre-deployment position by the unfurling of the stabilizer ribbon 374. The activation pin 336 may otherwise be extracted from the fuze delay device 300 by alternative approaches, and the manner in which the pin is released from the fuze delay device is not critical to the operation of the invention.

The extraction of the activation pin 336 frees the compression spring 62. Upon its release, the compression spring 62 drives the ampoule breaker 334 into the container 56, breaks the container and exposes the timing ball 338 to the reactant fluid 58 at Step 404. This exposure initiates a reaction causing an erosion of the timing ball at Step 406. As can best be seen in FIG. 20, the movement of the ampoule breaker 334 into the container 56 also moves the clamp 342 away from and out of contact with the interlock ball 330. With the clamp 342 no longer available as support for the interlock ball, the compression spring 62 is free to expand slightly and shift the secondary firing pin 314 incrementally towards the secondary detonator 22. The sloped wall 326 urging the interlock ball 330 slightly shifts the interlock ball into the first channel 308 against the sleeve member 358 of the piston 340.

Figure 20:
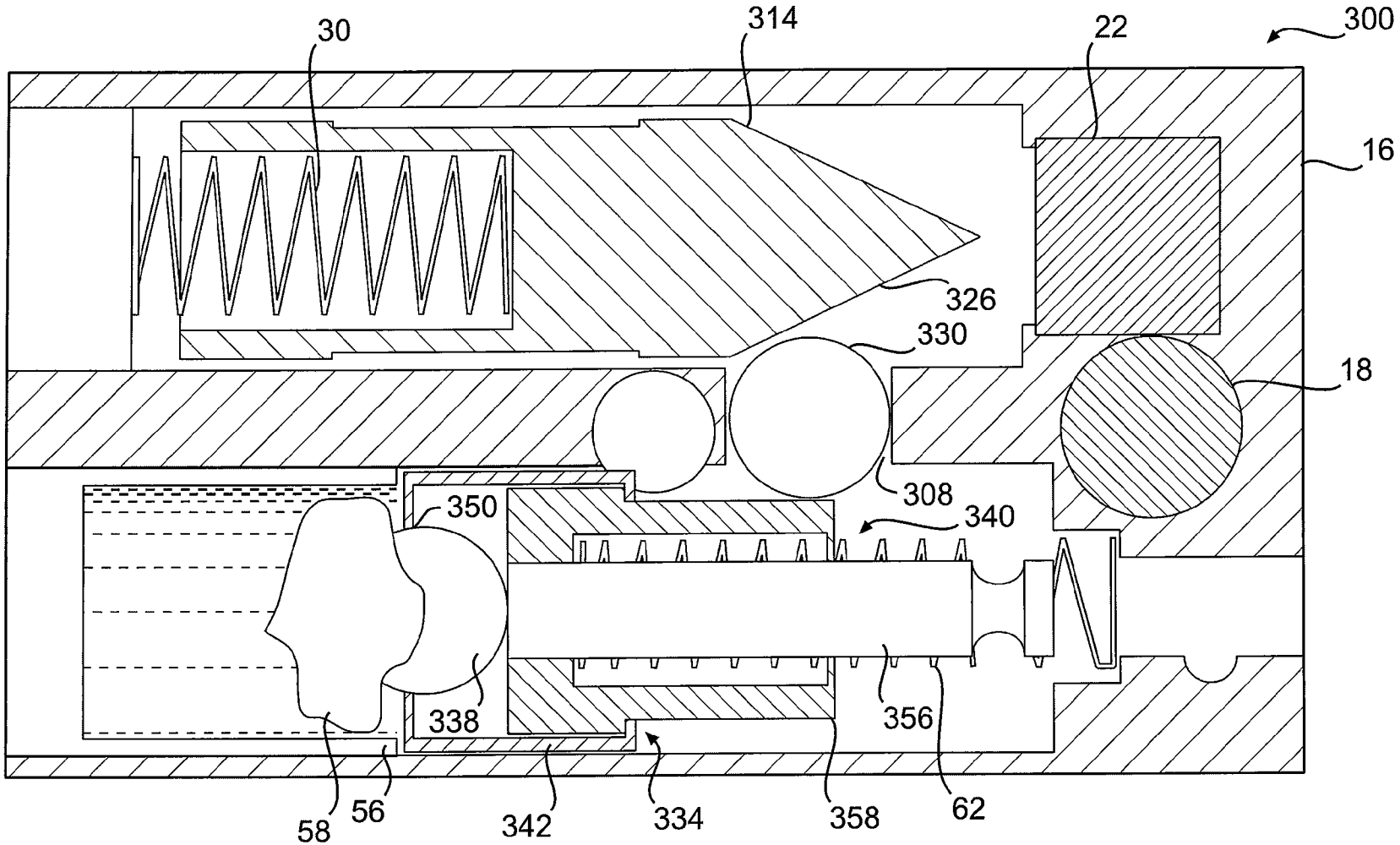
FIG. 20 is a top sectional view of the exemplary fuze delay device shown in FIG. 15 after deployment.

At Steps 404 and 406, the fuze delay device 300 appears, for example, in FIG. 20 with the compression spring 62 partially extended, the container 56 broken by the timing ball 338, the reactant fluid 58 initiating its erosion of the timing ball, and the interlock ball 330 slightly moved yet still restraining the shifted secondary firing pin 314. The sleeve member 358 now supports the interlock ball 330 and prevents further movement of the secondary firing pin 314 towards the secondary detonator 22.

In the case of projectile carrier, the entire submunition is spinning at a very high rate at ejection. While not being limited to a particular theory, the wind resistance of the air stream tends to cause the unfurled stabilizer ribbon 374 to resist the rotational spinning of the submunition 12. This resistance to rotation is transferred to the arming screw 378, causing the arming screw to rotate against the spinning submunition 12 and back out from its typical pre-deployment position that locks the fuze slide 16 in its safe position. Preferably the backing out of the arming screw 378 from its pre-deployment position releases the fuze slide to move, under the rotational forces of the deployed submunition, to its armed position, as readily understood by a skilled artisan. However, not all submunitions are spinning projectile. For example, as discussed above, a missile is a non-spin submunition; meaning that rotation is not available to arm a deployed missile. Instead, the arming screw backs out because of the vibration induced as the submunition descends. That is, a loose fit between the arming screw and its housing, along with the screw's weight allows the arming screw to back out, which releases the spring loaded slide to align the firing pin with the detonator, as readily understood by a skilled artisan. Regardless of their spinning characteristics, submunitions are designed so that when the munition is designed to explode (e.g., upon impact with its target), the main striker 20 with weight inertia initiates the primary detonator 18, causing a chain of explosions through the lead and main charges that destroys the submunition. In the preferred embodiments, the sequence of events described in this paragraph, from the arming screw 378 releasing the fuze slide 16 to the destruction of the submunition, occurs during the reaction between the timing ball 338 and the reactant fluid 58. In other words, if the submunition 12 works as normally intended, the chain of explosions will destroy the submunition while the reactant fluid 58 erodes the timing ball 338.

Figure 21:
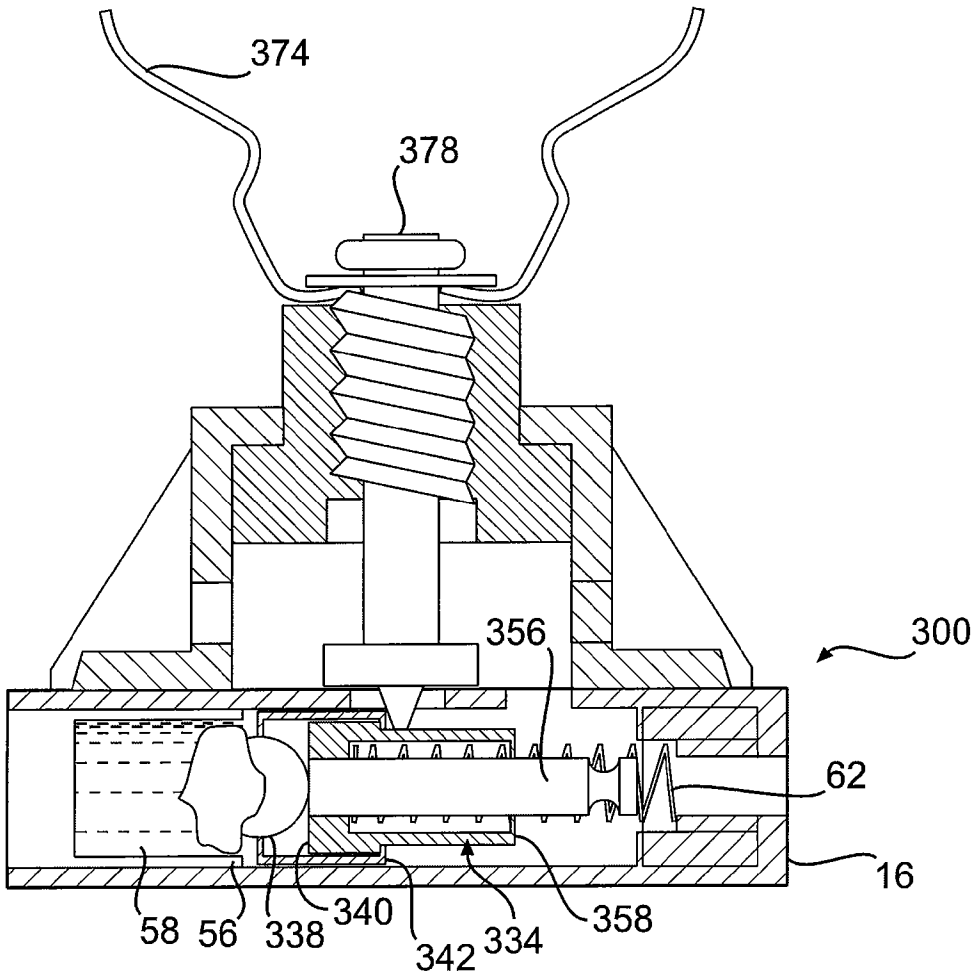
FIG. 21 is a side view partially in section of the exemplary fuze delay device shown in FIG. 20 after deployment.

However, if the submunition does not function normally, that is, explode upon hitting its target; the reactant fluid continues to erode the timing ball 338 (FIG. 21). After a predetermined delay (e.g., between about 25 seconds and 30 minutes) the timing ball 338 exposed to the reactant fluid 58 erodes to a point where it is small enough to pop through the aperture 350 of the clamp 342. The predetermined time period typically varies in accordance with several factors, for example, the composition of the reactant fluid, the composition and density of the timing ball 338 and the ambient temperature, as would be readily understood by a skilled artisan. For example, at hot to cold temperatures ranging from about 140° F. to 70° F. to (−20)° F. to (−30)° F. to (−40)° F., the average tested delay time for the timing ball 338 to erode and pop through the aperture 350 is about 1'26", 1'54", 9'48", 12'6" and 18'18", respectively.

Figure 22:
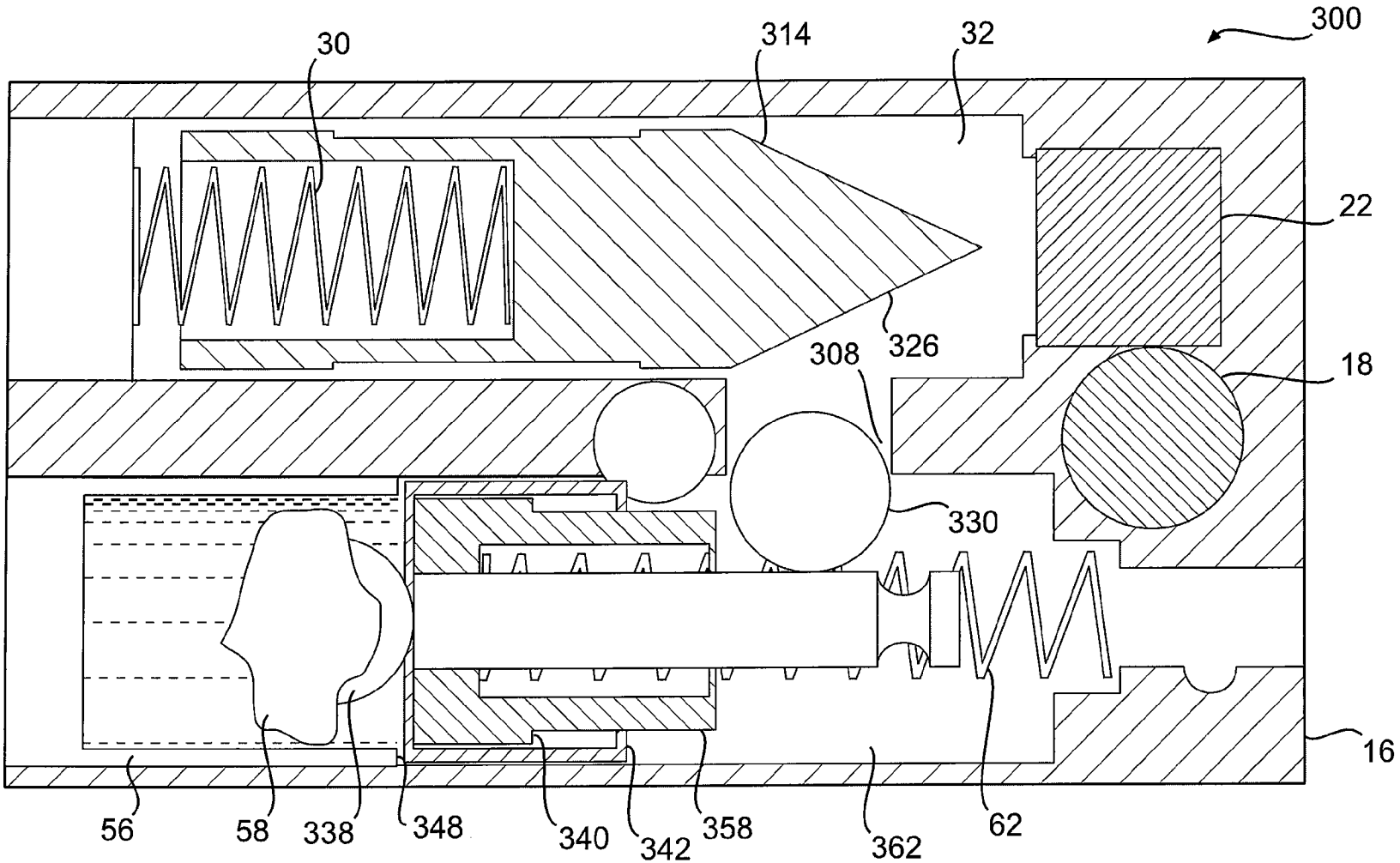
FIG. 22 is a top sectional view of the exemplary fuze delay device of FIG. 15 after erosion of the timing ball.
Figure 23:
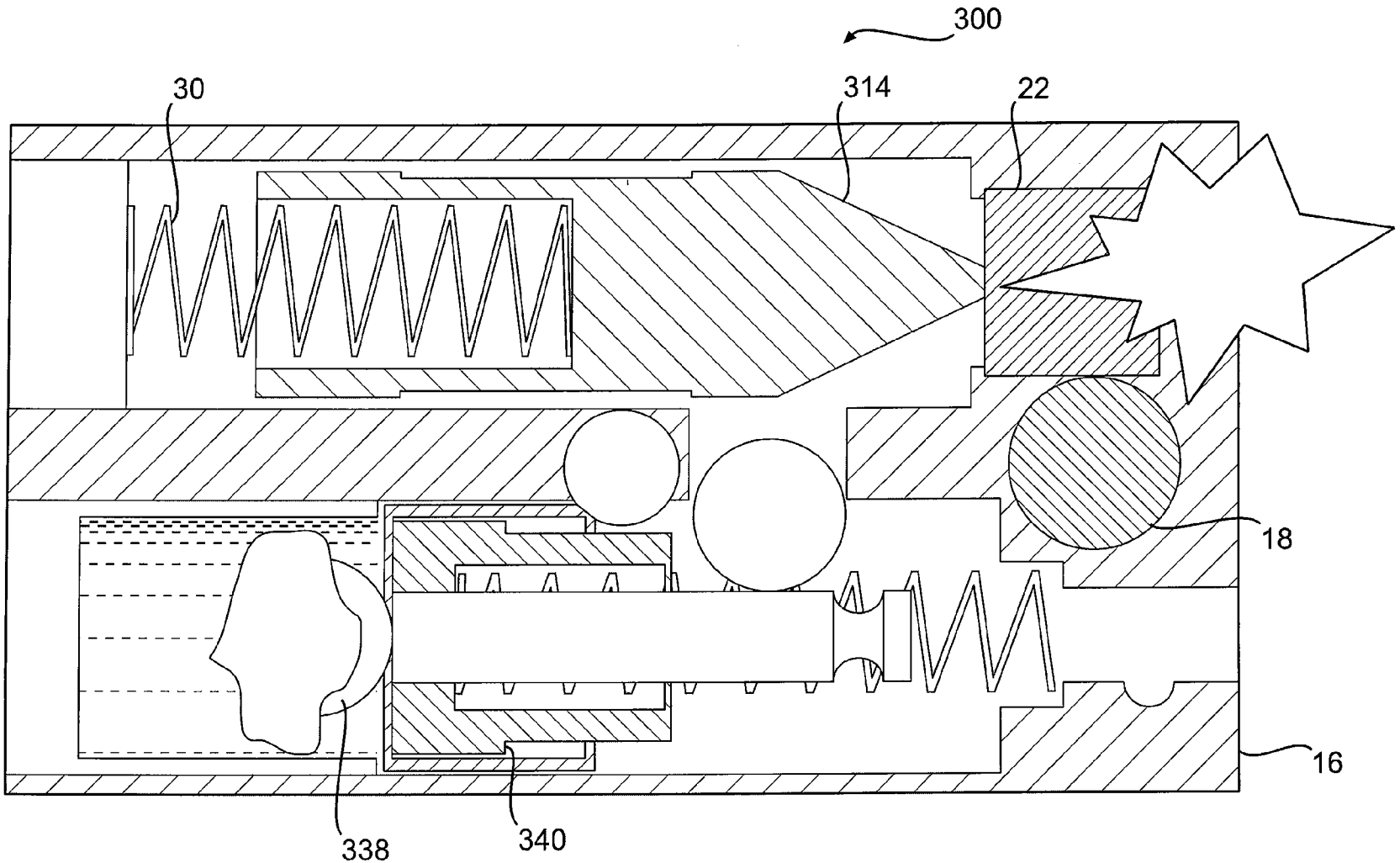
FIG. 23 is a top sectional view of the exemplary fuze delay device of FIG. 15 after release of the restraining unit.

As the timing ball 338 erodes to a size small enough to fit through the aperture 350, the force of the compression spring 62 pops the timing ball through the aperture at Step 408. As can be seen in FIG. 22, the compression spring 62 urges the piston 340 through the hollow cylindrical body of the clamp 342 until the piston abuts the first supporting wall 348. This movement of the piston 340 pushes the timing ball 338 into the container 56. As a result of this movement, the sleeve member 358 of the piston 340, which previously supported the interlock ball 330, moves out of its supporting position, thereby releasing the interlock ball to move further through the first channel 308 into the third channel 362 and out of the second channel 32. At this time, the interlock ball 330 is no longer available to restrict movement of the secondary firing pin 314.

Accordingly, the movement of the timing ball 338 and the piston 340 in step 408 releases the secondary firing pin 314. At Step 410, the compression spring 30 drives the released secondary firing pin 314 toward the secondary detonator 22, causing the secondary firing pin to impact and explode the secondary detonator 22. See, for example, FIG. 23, which depicts the secondary firing pin 314 at impact with the secondary detonator 22. As can best be seen in FIG. 23, at Step 412 output from the exploded secondary detonator 22 initiates the adjacent primary detonator 18, causing it to explode and sterilize the submunition 12 when the fuze slide 16 is not armed. However, if at this time the fuze slide 16 is in its armed position, such that the primary detonator 18 is aligned with the main charge, then at Step 414 the initiation of the primary detonator from the secondary detonator 22 fires the main charge and destroys the submunition 12 (e.g., grenade, missile, rocket warhead munition). Accordingly, the self-destruct fuze delay device 300 also ensures sterilization or destruction of the submunition 12 in a timely manner depending on the relationship between the primary detonator 18 and the main charge.

It is understood that the method and mechanism for making and using the self-destruct fuze delay device described herein are exemplary indications of preferred embodiments of the invention, and are given by way of illustration only. It other words, the concept of the present invention may be readily applied to a variety of preferred embodiments, including those disclosed herein.

While the invention has been described in detail and with reference to specific examples thereof, it will be apparent to one skilled in the art that various changes and modifications can be made therein without departing from the spirit and scope thereof. For example, the SD fuze delay device is applicable to all the various ICM items including the submunitions of the non-rotating GMLRS/MLRS warheads. For non-rotating submunitions, deployment into the air stream induces vibration sufficient to cause the arming screw to back out, allowing the fuze slide to move into the armed position. Accordingly and preferably, upon deployment of rotating or non-rotating submunitions into the atmosphere, the ribbon unfurls, the safety and retainer pins extract, and the fuze slide moves to its armed position. Moreover, while the wicks are shown encircling the weakened area of the restraining link, it is understood that such preferred relationship is not required, as long as the wick is adjacent the weakened area to expedite the desired failure. As another example, the timing ball 338 could be coupled or integral with the piston 340, and the container 56 or insulator 332 constructed to restrict movement of the timing ball upon collision with the container to an opening about the size of the aperture 350; that is, having a diameter smaller than the diameter of the timing ball. In this example, the timing ball 338 does not pop through the opening and into the container 56 until the reactant fluid 58 erodes the timing ball to a size that allows passage through the opening. Without further elaboration, the foregoing will so fully illustrate the invention that other may, by applying current or future knowledge, readily adapt the same for use under various conditions of service.

What is claimed is:

1. A self-destruct fuze delay device for a submunition, the submunition having a longitudinal axis, a main charge and a detonating fuze for initiating the main charge upon impact, the detonating fuze having a movable slide, said self-destruct faze delay device comprising:

a detonator mounted to a movable slide;

a delay mechanism offset and substantially orthogonal to the longitudinal axis, said delay mechanism including an energizing source and a self-destruct firing pin, said self-destruct firing pin aligned with said detonator and urged toward said detonator in a first direction by said energizing source;

a restraining unit movable between a first position within the movable slide, in which said restraining unit abuts said self-destruct firing pin and holds said self-destruct firing pin away from said detonator, and a second position within the movable slide offset from the first position in a second direction in which said restraining unit allows said energizing source to move said self-destruct firing pin into said detonator; and an activation mechanism offset from said delay mechanism and supporting said restraining unit in the first position against said self-destruct firing pin, said activation mechanism adapted to shift after a delay and release its support of said restraining unit against said self-destruct firing pin to allow movement of said restraining unit to the second position, said activation mechanism including a container holding a fluid, and a breaking member that breaks said container and accesses said fluid to erode said breaking member over the delay and release the support of said restraining unit against said self-defense firing pin, said breaking member including a timing ball in contact with a piston, said timing ball adapted to break said container, access the fluid, erode when exposed to the fluid during the delay, and move into said container after the delay.

2. The device of claim 1, wherein the first direction is different that the second direction.

3. The device of claim 1, wherein said activation mechanism further includes a second energizing source that causes the contact between said breaking member and said container.

4. The device of claim 3, wherein said first energizing source and said second energizing source each include a compression spring.

5. The device of claim 3, wherein said container is a glass ampoule and said breaking member is an ampoule weight that is urged by said second energizing source to contact and break said glass ampoule to access said fluid.

6. The device of claim 1, said piston supporting said restraining unit during the erosion of said timing ball, and said piston releasing its support of said restraining unit when said timing ball moves into said container after the delay.

7. The device of claim 1, further comprising a ribbon retainer that restricts an unfurling of a stabilizer ribbon prior to a deployment of the submunition, and that is extracted upon the unfurling of the stabilizer ribbon after the deployment.

8. The device of claim 7, said activation mechanism further including a retainer pin that maintains separation between said container and said breaking member prior to a deployment of the submunition, said retainer pin abutting said breaking member and engaged with said ribbon retainer to extract from said breaking member upon the extraction of said ribbon retainer.

9. The device of claim 7, wherein said ribbon retainer includes a housing surrounding the fuze slide and at least partially covering said unfurled stabilizer ribbon.

10. The device of claim 1, the detonating fuze having a main detonator movable between a safety position and an armed position, wherein the urging of said self-destruct firing pin toward the detonator by said energizing source causes said self-destruct firing pin to contact and explode said detonator, which explodes said main detonator.

11. The device of claim 10, wherein the explosion of said main detonator initiates the main charge and destroys the submunition to explode when said main detonator is in the armed position.

12. The device of claim 1, wherein the movable slide includes a channel between said delay mechanism and said activation mechanism, and restraining unit includes an interlock ball that moves within said channel between the first position and the second position.

13. A self-destruct fuze delay device for a submunition, the submunition having a longitudinal axis, a main charge and a detonating fuze for initiating the main charge upon impact, the detonating fuze having a movable slide, said self-destruct fuze delay device comprising:

a detonator mounted to a movable slide;

a delay mechanism offset and substantially orthogonal to the longitudinal axis, said delay mechanism including an energizing source and a self-destruct firing pin, said self-destruct firing pin aligned with said detonator and urged toward said detonator by said energizing source;

an activation mechanism offset from said delay mechanism, said activation mechanism including a container holding a fluid, and a breaking member that breaks said container and accesses the fluid, which erodes said breaking member over a delay and releases a hold against said self-defense firing pin; and a restraining unit movable between a first position supported by said activation mechanism against said self-destruct firing pin to hold said self-destruct firing pin away from said detonator, and a second position that releases the hold against said self-destruct firing pin and allows said energizing source to move said self-destruct firing pin into said detonator, wherein the movable slide includes a channel between said delay mechanism and said activation mechanism, and the restraining unit includes an interlock ball that moves within said channel between the first position and the second position.

14. The device of claim 13, wherein said activation mechanism further includes a second energizing source that urges said second energizing source to contact and break said container to access said fluid.

15. The device of claim 14, wherein said breaking member includes a timing ball in contact with a piston, said timing ball adapted to break said container, access the fluid, erode when in contact with the fluid during the delay, and move to the second position inside said container after the delay, said piston supporting said restraining unit during the erosion of said timing ball, and said piston releasing its support of said restraining unit when said timing ball moves to the second position, which releases the hold against said self-destruct firing pin and allows said energizing source to move said self-destruct firing pin into said detonator into said container.

* * * * *